US012644637B2

(12) United States Patent
Song et al.

(10) Patent No.: US 12,644,637 B2
(45) Date of Patent: Jun. 2, 2026

(54) REFRIGERATOR

(71) Applicant: LG ELECTRONICS INC., Seoul (KR)

(72) Inventors: Youngseung Song, Seoul (KR); Kyongbae Park, Seoul (KR); Yunsu Cho, Seoul (KR); Namsoo Cho, Seoul (KR); Kyunghun Cha, Seoul (KR); Sangbok Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 72 days.

(21) Appl. No.: 17/923,710

(22) PCT Filed: Apr. 21, 2021

(86) PCT No.: PCT/KR2021/005054

§ 371 (c)(1),
(2) Date: Nov. 7, 2022

(87) PCT Pub. No.: WO2021/225307

PCT Pub. Date: Nov. 11, 2021

(65) Prior Publication Data

US 2023/0175758 A1 Jun. 8, 2023

(30) Foreign Application Priority Data

May 7, 2020 (KR) ..... 10-2020-0054350
May 7, 2020 (KR) ..... 10-2020-0054357

(51) Int. Cl.
*F25D 21/00* (2006.01)
*F25D 21/08* (2006.01)

(52) U.S. Cl.
CPC ..... *F25D 21/006* (2013.01); *F25D 21/08* (2013.01)

(58) Field of Classification Search
CPC ..... F25B 2700/13; F25B 2600/05; F25D 2600/02
See application file for complete search history.

(56) References Cited

U.S. PATENT DOCUMENTS 2,781,646 A * 2/1957 Buchanan ..... F25D 21/08 62/503
4,145,893 A * 3/1979 Vogel ..... F25D 21/04 62/255

(Continued)

FOREIGN PATENT DOCUMENTS

EP 2520880 A1 11/2012
JP 2012167896 A * 9/2012 ..... F16K 37/0041

(Continued)

*Primary Examiner* — Jianying C Atkisson
*Assistant Examiner* — Meraj A Shaikh
(74) *Attorney, Agent, or Firm* — Bryan Cave Leighton Paisner LLP

(57) ABSTRACT

A refrigerator according to an embodiment includes an evaporator; a defrost heater; a temperature sensor to sense a temperature associated with the evaporator; and a controller to control the defrost heater. In response to reaching a defrost operation starting point, the controller is configured to perform a defrost operation mode, perform a continuous operation mode, in which the defrost heater continuously turns on, and a pulsed operation mode, in which the defrost heater switches between on and off, based on the defrost operation mode. In response to performing the pulsed operation mode, the controller is configured to change the ON duration or power level of the defrost heater.

22 Claims, 19 Drawing Sheets

(56) References Cited

U.S. PATENT DOCUMENTS

| | | | | | |
|---|---|---|---|---|---|
| 4,732,010 | A * | 3/1988 | Linstromberg | ..... | F25D 17/045<br>62/155 |
| 2017/0343269 | A1* | 11/2017 | Kim | ..... | F25D 23/068 |
| 2018/0313597 | A1* | 11/2018 | Lee | ..... | F25D 21/08 |
| 2019/0257567 | A1* | 8/2019 | Sanders | ..... | F25D 21/04 |

FOREIGN PATENT DOCUMENTS

| | | | | |
|---|---|---|---|---|
| JP | 2014-052155 | A | | 3/2014 |
| JP | 2019138510 | A | * | 8/2019 |
| KR | 10-2004-0057156 | A | | 7/2004 |
| KR | 10-2010-0032532 | A | | 3/2010 |
| KR | 10-2014-0074653 | A | | 6/2014 |
| KR | 10-2018-0120975 | A | | 11/2018 |

* cited by examiner

REFRIGERATOR

This application is the National Stage filing under 35 U.S.C. 371 of International Application No. PCT/KR2021/005054, filed Apr. 21, 2021, which claims priority to and the benefit of Korean Patent Application No. 10-2020-0054350, filed on May 7, 2020, and Korean Patent Application No. 10-2020-0054357, filed on May 7, 2020, the disclosure of which is incorporated herein by reference in its entirety.

BACKGROUND

Field of the Disclosure

The present disclosure relates to a refrigerator, and more particularly, to a refrigerator capable of improving defrosting efficiency and power consumption.

Background

For long-term storage of food in a refrigerator, a refrigerator temperature is reduced using a compressor and an evaporator. For example, a freezer compartment in the refrigerator is maintained at a temperature of approximately −18° C.

Meanwhile, in order to improve refrigerator performance, it is desirable to remove frost which may be on the evaporator when the evaporator operates.

Korean Patent Application Laid-Open No. 10-2001-0026176 (hereinafter, referred to as Document 1) relates to a method for controlling a defrost heater of a refrigerator, in which the defrost heater is turned on when a certain time for defrosting arrives, and turned off after the certain period of time for defrosting lapses.

However, according to Document 1, since the ON time and the OFF time of the defrost heater are based on a certain time or a predetermined time, defrosting is not performed according to the actual amount of frost on an evaporator. That is, when the amount of frost is large, defrosting is not performed properly, or when the amount of frost is small, unnecessary defrosting is performed, thereby unnecessarily consuming power.

U.S. Pat. No. 6,694,754 (hereinafter, referred to as Document 2) relates to a refrigerator having a pulse-based defrost heater, and discloses that the On and off time of a defrost heater is determined based on time.

According to Document 2, since the ON time and the OFF time of the defrost heater are determined based on time, defrosting is not performed according to the actual amount of frost on an evaporator. That is, when the amount of frost is large, defrosting is not performed properly, or when the amount of frost is small, unnecessary defrosting is performed, thereby unnecessarily consuming power.

Korean Patent Application Laid-Open No. 10-2016-0053502 (hereinafter, referred to as Document 3) relates to a defrosting device, a refrigerator having the same, and a control method of the defrosting device, in which the ON and OFF time of a defrost heater is determined based on time or time and temperature.

According to Document 3, since the ON time and the OFF time of the defrost heater are determined based on time or time and temperature, defrosting is not performed according to the actual amount of frost on an evaporator. That is, when the amount of frost is large, defrosting is not performed properly, or when the amount of frost is small, unnecessary defrosting is performed, thereby unnecessarily consuming power.

SUMMARY

An aspect of the present disclosure provides a refrigerator capable of improving defrosting efficiency and power consumption.

Another aspect of the present disclosure provides a refrigerator capable of varying an ON period or power level of a defrost heater in response to the defrost heater performing a pulse operation mode.

Further, another aspect of the present disclosure provides a refrigerator capable of performing defrosting based on a temperature change rate.

In one aspect, a refrigerator includes: an evaporator configured to perform heat exchange; a defrost heater configured to operate to remove frost formed on the evaporator; a temperature sensor configured to detect a temperature associated with the evaporator; and a controller configured to control the defrost heater, wherein, in response to a defrosting operation start time point arriving, the controller is configured to perform a defrost operation mode, perform a continuous operation mode, in which the defrost heater is continuously turned on, and a pulse operation mode, in which the defrost heater is repeatedly turned on and off based on the defrost operation mode, and change an ON period or a power level of the defrost heater in response to performing the pulse operation mode.

In response to performing a pulse operation mode, the controller may be configured to decrease the ON period or the power level of the defrost heater stepwise or sequentially.

In response to performing the pulse operation mode, the controller may be configured to turn on the defrost heater during a first turn on period, turn off the defrost heater during a first turn off period, and turn on the defrost heater during a second turn on period that is less than the first turn on period.

In response to performing the pulse operation mode, the controller may be configured to turn on the defrost heater during a fourth turn on period that is the minimum ON period.

The controller may be configured to turn on the defrost heater at a first power level during the first turn on period and turn on the defrost heater at the first power level during the third turn on period.

In response to performing the pulse operation mode, the controller may be configured to turn on and off the defrost heater during the first period, and turn on and off the defrost heater during the second period that is less than the first period.

In response to performing the pulse operation mode, the controller may be configured to turn on and off the defrost heater during the third period that is less than the second period, and turn on and off the defrost heater during the fourth period, which is the minimum period, after the third period.

In response to performing the pulse operation mode, the controller may be configured to turn on the defrost heater based on the first power level during the first turn on period, turn off the defrost heater during the first turn off period, and turn on the defrost heater at the second power level that is less than the first power level during the second turn on period.

In response to performing the pulse operation mode, the controller may be configured to turn on the defrost heater at a third power level, which is a minimum power level, after the second turn on period.

In response to the defrosting operation start time point arriving while performing the normal cooling operation mode, the controller may be configured to perform the defrost operation mode including the pre-defrost cooling mode, the heater operation mode, and the post-defrost cooling mode, and may be configured to perform the continuous operation mode of the defrost heater and the pulse operation mode in which the defrost heater is repeatedly turned on and off based on the heater operation mode.

The controller may be configured to continuously turn on the defrost heater based on the continuous operation mode, and in response to a change rate of the temperature associated with the evaporator detected by the temperature sensor being equal to or greater than a first reference value in the ON state of the defrost heater, the controller may be configured to perform the pulse operation mode and turn off the defrost heater, and in response to the change rate of the temperature associated with the evaporator being less than or equal to a second reference value that is less than the first reference value in the OFF state of the defrost heater during the pulse operation mode, the controller may be configured to turn on the defrost heater.

The controller may be configured to turn off the defrost heater based on the heater pulse operation end condition.

The controller may be configured to continuously turn on the defrost heater based on the continuous operation mode, and repeat on and off of the defrost heater for the change rate of the temperature associated with the evaporator to be between a first reference value and a second reference value based on the pulse operation mode.

In response to the temperature detected by the temperature sensor corresponding to a predetermined temperature, the controller may be configured to perform the pulse operation mode.

In response to the temperature detected by the temperature sensor corresponding to a predetermined temperature, and the duration of the continuous operation mode is greater than a predetermined period, the controller may be configured to perform the pulse operation mode.

In response to the duration of the continuous operation mode being greater than a predetermined period, the controller may be configured to perform the pulse operation mode.

The controller may be configured to perform the pulse operation mode based on the temperature change rate of the temperature detected by the temperature sensor.

The controller may be configured to operate the heater with power inversely proportional to the temperature change rate of the temperature detected by the sensor during the pulse operation mode.

The controller may be configured to, as the number of opening times of the cooling compartment door increases, decrease the duration of the defrost operation mode.

In response to performing the pulse operation mode, the controller may be configured to turn on and off the defrost heater based on the change rate of the temperature detected by the temperature sensor.

In another aspect, a refrigerator includes: an evaporator configured to perform heat exchange; a defrost heater configured to operate to remove frost formed on the evaporator; a temperature sensor configured to detect a temperature associated with the evaporator; and a controller configured to control the defrost heater, wherein, in response to a defrosting operation start time point arriving, the controller is configured to perform a defrost operation mode, perform a continuous operation mode, in which the defrost heater is continuously turned on, and a pulse operation mode, in which the defrost heater is repeatedly turned on and off based on the defrost operation mode, and in response to performing the pulse operation mode, turn on and off the defrost heater based on the change rate of the temperature detected by the temperature sensor.

The controller may be configured to turn on the defrost heater in response to the change rate of the temperature associated with the evaporator being greater than or equal to the first reference value in the state in which the defrost heater is turned on during the pulse operation mode.

The controller may be configured to control a peak temperature arrival point of the evaporator in response to the continuous operation mode and the pulse operation mode being performed in the defrost operation mode to be later than a peak temperature arrival point of the evaporator in response to the defrost heater being only continuously turned on in the defrost operation mode.

The controller may be configured to control a size of a second section related to a temperature versus time between a phase-change temperature and a defrost end temperature in response to the continuous operation mode and the pulse operation mode being performed in the defrost operation mode to be greater than a size of a first section related to a temperature versus time between the phase-change temperature and the defrost end temperature in response to the defrost heater being only continuously turned on in the defrost operation mode.

The controller may be configured to control an effective defrost in response to the continuous operation mode and the pulse operation mode being performed in the defrost operation mode to be greater than an effective defrost in response to the defrost heater being only continuously turned on in the defrost operation mode.

The controller may be configured to control a heater OFF time point in response to the continuous operation mode and the pulse operation mode being performed in the defrost operation mode to be later than a heater OFF time point in response to the defrost heater being only continuously turned on in the defrost operation mode.

The controller may be configured to control a period between the heater OFF time point and the peak temperature arrival time point of the evaporator in response to the continuous operation mode and the pulse operation mode being performed in the defrost operation mode to be greater than a period between the heater OFF time point and the peak temperature arrival time point of the evaporator in response to the defrost heater being only continuously turned on in the defrost operation mode.

The controller may be configured to control a period during which a temperature is maintained above a phase-change temperature in response to the continuous operation mode and the pulse operation mode being performed in the defrost operation mode to be greater than a period during which a temperature is maintained above the phase-change temperature in response to the defrost heater being continuously turned on in the defrost operation mode.

The controller may be configured to control a period between the heater OFF time point and a time point at which a temperature falls below the phase-change temperature in response to the continuous operation mode and the pulse operation mode being performed in the defrost operation mode to be shorter than the period between the heater OFF time point and the time point at which a temperature falls below the phase-change temperature in response to the defrost heater being continuously turned on in the defrost operation mode.

The controller may be configured to control a size of an overheat temperature region higher than the defrost end temperature in response to the continuous operation mode and the pulse operation mode being performed in the defrost operation mode to be less than a size of the overheat temperature region higher than the defrost end temperature in response to the defrost heater being only continuously turned on in the defrost operation mode.

The controller may be configured to control a cooling power supply time point based on a cooling operation mode in response to the continuous operation mode and the pulse operation mode being performed in the defrost operation mode to be later than the cooling power supply time point according to a normal cooling operation mode in response to the defrost heater being only continuously turned on in the defrost operation mode.

Further, in another aspect, a refrigerator includes: an evaporator configured to perform heat exchange; a defrost heater configured to operate to remove frost formed on the evaporator; a temperature sensor configured to detect a temperature associated with the evaporator; and a controller configured to control the defrost heater, wherein, in response to a defrosting operation start time point arriving, the controller is configured to perform a defrost operation mode, perform a continuous operation mode, in which the defrost heater is continuously turned on, and a pulse operation mode, in which the defrost heater is repeatedly turned on and off based on the defrost operation mode, and control a size of a second section related to temperature versus time between a phase-change temperature and the defrost end temperature in response to the continuous operation mode and the pulse operation mode being performed in the defrost operation mode to be greater than a size of a first section related to temperature versus time between the phase-change temperature and the defrosting end temperature in response to the defrost heater being only continuously turned on in the defrost operation mode.

A refrigerator according to an embodiment of the present disclosure includes: an evaporator configured to perform heat exchange; a defrost heater configured to operate to remove frost formed on the evaporator; a temperature sensor configured to detect a temperature associated with the evaporator; and a controller configured to control the defrost heater, wherein, in response to a defrosting operation start time point arriving, the controller is configured to perform a defrost operation mode, perform a continuous operation mode, in which the defrost heater is continuously turned on, and a pulse operation mode, in which the defrost heater is repeatedly turned on and off based on the defrost operation mode, and change an ON period or a power level of the defrost heater in response to performing the pulse operation mode. Accordingly, it may be possible to improve the defrosting efficiency and reduce the power consumption. In particular, since defrosting is performed according to the amount of frost of the actual evaporator, it may be possible to improve defrosting efficiency and power consumption.

Meanwhile, in response to performing a pulse operation mode, the controller may be configured to decrease the ON period or the power level of the defrost heater stepwise or sequentially. Accordingly, it may be possible to improve the defrosting efficiency and reduce the power consumption.

Meanwhile, in response to performing the pulse operation mode, the controller may be configured to turn on the defrost heater during a first turn on period, turn off the defrost heater during a first turn off period, and turn on the defrost heater during a second turn on period that is less than the first turn on period. Accordingly, it may be possible to improve the defrosting efficiency and reduce the power consumption.

Meanwhile, in response to performing the pulse operation mode, the controller may be configured to turn on the defrost heater during a fourth turn on period corresponding to a minimum ON period. Accordingly, it may be possible to improve the defrosting efficiency and reduce the power consumption.

Meanwhile, the controller may be configured to turn on the defrost heater at a first power level during the first turn on period and turn on the defrost heater at the first power level during the third turn on period. Accordingly, it may be possible to improve the defrosting efficiency and reduce the power consumption.

Meanwhile, in response to performing the pulse operation mode, the controller may be configured to turn on and off the defrost heater during a first period, and turn on and off the defrost heater during a second period that is less than the first period.

Meanwhile, in response to performing the pulse operation mode, the controller may be configured to turn on and off the defrost heater during the third period that is less than the second period, and turn on and off the defrost heater during the fourth period, which is a minimum period, after the third period. Accordingly, it may be possible to improve the defrosting efficiency and reduce the power consumption.

Meanwhile, in response to performing the pulse operation mode, the controller may be configured to turn on the defrost heater based on the first power level during the first turn on period, turn off the defrost heater during the first turn off period, and turn on the defrost heater at the second power level that is less than the first power level during the second turn on period. Accordingly, it may be possible to improve the defrosting efficiency and reduce the power consumption.

Meanwhile, in response to performing the pulse operation mode, the controller may be configured to turn on the defrost heater at a third power level, which is a minimum power level, after the second turn on period. Accordingly, it may be possible to improve the defrosting efficiency and reduce the power consumption.

Meanwhile, in response to the defrosting operation start time point arriving while performing the normal cooling operation mode, the controller may be configured to control the defrost operation mode including a pre-defrost cooling mode, a heater operation mode, and a post-defrost cooling mode is performed, and may be configured to perform the continuous operation mode of the defrost heater and the pulse operation mode in which the defrost heater is repeatedly turned on and off based on the heater operation mode. Accordingly, it may be possible to improve the defrosting efficiency and reduce the power consumption.

Meanwhile, the controller may be configured to continuously turn on the defrost heater based on the continuous operation mode, in the ON state of the defrost heater, in response to a change rate of the temperature associated with the evaporator detected by the temperature sensor being greater than or equal to a first reference value, perform the pulse operation mode and turn off the defrost heater, and turn on the defrost heater in response to the change rate of the temperature associated the evaporator being less than or equal to a second reference value that is less than the first reference value, in a state in which the defrost heater is turned off during the pulse operation mode. Accordingly, it may be possible to improve the defrosting efficiency and reduce the power consumption.

Meanwhile, the controller may be configured to turn off the defrost heater based on the heater pulse operation end condition. Accordingly, it may be possible to improve the defrosting efficiency and reduce the power consumption.

Meanwhile, the controller may be configured to continuously turn on the defrost heater based on the continuous operation mode, and the defrost heater to be repeatedly turned on and off for the change rate of the temperature associated with the evaporator to be between a first reference value and a second reference value based on the pulse operation mode. Accordingly, it may be possible to improve the defrosting efficiency and reduce the power consumption.

Meanwhile, in response to the temperature detected by the temperature sensor corresponding to a predetermined temperature, the controller may be configured to perform the pulse operation mode. Accordingly, it may be possible to improve the defrosting efficiency and reduce the power consumption.

Meanwhile, in response to the temperature detected by the temperature sensor corresponding to a predetermined temperature, and a duration of the continuous operation mode is greater than a predetermined period, the controller may be configured to perform the pulse operation mode. Accordingly, it may be possible to improve the defrosting efficiency and reduce the power consumption.

Meanwhile, in response to the duration of the continuous operation mode being greater than a predetermined period, the controller may be configured to perform the pulse operation mode. Accordingly, it may be possible to improve the defrosting efficiency and reduce the power consumption.

Meanwhile, the controller may be configured to perform the pulse operation mode based on the temperature change rate of the temperature detected by the temperature sensor. Accordingly, it may be possible to improve the defrosting efficiency and reduce the power consumption.

Meanwhile, the controller may be configured to operate the heater with power inversely proportional to the temperature change rate of the temperature detected by the sensor during the pulse operation mode. Accordingly, it may be possible to improve the defrosting efficiency and reduce the power consumption.

Meanwhile, the controller may be configured to, as the number of opening times of the cooling compartment door increases, decrease the duration of the defrost operation mode. Accordingly, it may be possible to improve the defrosting efficiency and reduce the power consumption.

Meanwhile, in response to performing the pulse operation mode, the controller may be configured to turn on and off the defrost heater based on the change rate of the temperature detected by the temperature sensor. Accordingly, since defrosting may be performed based on the temperature change rate, it may be possible to improve defrosting efficiency and power consumption.

Meanwhile, a refrigerator according to another embodiment of the present disclosure includes: an evaporator configured to perform heat exchange; a defrost heater configured to operate to remove frost formed on the evaporator; a temperature sensor configured to detect a temperature associated with the evaporator; and a controller configured to control the defrost heater, wherein, in response to a defrosting operation start time point arriving, the controller is configured to perform a defrost operation mode, perform a continuous operation mode, in which the defrost heater is continuously turned on, and a pulse operation mode, in which the defrost heater is repeatedly turned on and off based on the defrost operation mode, and in response to performing the pulse operation mode, turn on and off the defrost heater based on the change rate of the temperature detected by the temperature sensor. Accordingly, since the defrosting may be performed based on the temperature change rate, it may be possible to improve defrosting efficiency and power consumption.

In particular, since the defrosting is performed according to the amount of frost of the actual evaporator, it may be possible to improve defrosting efficiency and power consumption.

Meanwhile, the controller may be configured to turn on the defrost heater in response to the change rate of the temperature associated with the evaporator being greater than or equal to a first reference value in the state in which the defrost heater is turned on during the pulse operation mode. Accordingly, it may be possible to improve the defrosting efficiency and reduce the power consumption.

Meanwhile, the controller may be configured to control a peak temperature arrival time point of the evaporator in response to the continuous operation mode and the pulse operation mode being performed in the defrost operation mode to be later than the peak temperature arrival time point of the evaporator in response to the defrost heater being only continuously turned on in the defrost operation mode. Accordingly, it may be possible to improve the defrosting efficiency and power consumption in response to the continuous operation mode and the pulse operation mode being performed in the defrost operation mode.

Meanwhile, the controller may be configured to control a size of a second section related to temperature versus time between a phase-change temperature and the defrost end temperature in response to the continuous operation mode and the pulse operation mode being performed in the defrost operation mode to be greater than a size of a first section related to temperature versus time between the phase-change temperature and the defrost end temperature in response to the defrost heater being only continuously turned on in the defrost operation mode. Accordingly, it may be possible to improve the defrosting efficiency and power consumption in response to the continuous operation mode and the pulse operation mode being performed in the defrost operation mode.

Meanwhile, the controller may be configured to control an effective defrost in response to the continuous operation mode and the pulse operation mode being performed in the defrost operation mode to be larger than the effective defrost in response to the defrost heater being only continuously turned on in the defrost operation mode. Accordingly, it may be possible to improve the defrosting efficiency and power consumption in response to the continuous operation mode and the pulse operation mode being performed in the defrost operation mode.

Meanwhile, the controller may be configured to control a heater OFF time point in response to the continuous operation mode and the pulse operation mode being performed in the defrost operation mode to be later than the heater OFF time point in response to the defrost heater being only continuously turned on in the defrost operation mode. Accordingly, it may be possible to improve the defrosting efficiency and power consumption in response to the continuous operation mode and the pulse operation mode being performed in the defrost operation mode.

Meanwhile, the controller may be configured to control a period between the heater OFF time point and the peak temperature arrival time point of the evaporator in response to the continuous operation mode and the pulse operation mode being performed in the defrost operation mode to be greater than a period between the heater OFF time point and the peak temperature arrival time point of the evaporator in response to the defrost heater being continuously turned on in the defrost operation mode. Accordingly, it may be possible to improve the defrosting efficiency and power consumption in response to the continuous operation mode and the pulse operation mode being performed in the defrost operation mode.

Meanwhile, the controller may be configured to control a period during which a temperature is maintained above a phase-change temperature in response to the continuous operation mode and the pulse operation mode being performed in the defrost operation mode to be greater than a period during which a temperature is maintained the phase-change temperature in response to the defrost heater being continuously turned on in the defrost operation mode. Accordingly, it may be possible to improve the defrosting efficiency and power consumption in response to the continuous operation mode and the pulse operation mode being performed in the defrost operation mode.

Meanwhile, the controller may be configured to control a period between the heater OFF time point and a time point at which a temperature falls below the phase-change temperature in response to the continuous operation mode and the pulse operation mode being performed in the defrost operation mode to be shorter than the period between the heater OFF time point and the time point at which a temperature falls below the phase-change temperature in response to the defrost heater being continuously turned on in the defrost operation mode in the defrost operation mode. Accordingly, it may be possible to improve the defrosting efficiency and power consumption in response to the continuous operation mode and the pulse operation mode being performed in the defrost operation mode.

Meanwhile, the controller may be configured to control a size of an overheat temperature region higher than the defrost end temperature in response to the continuous operation mode and the pulse operation mode being performed in the defrost operation mode to be less than a size of the overheat temperature region higher than the defrost end temperature in response to the defrost heater being only continuously turned on in the defrost operation mode. Accordingly, it may be possible to improve the defrosting efficiency and power consumption in response to the continuous operation mode and the pulse operation mode being performed in the defrost operation mode.

Meanwhile, the controller may be configured to control a cooling power supply time point based on a cooling operation mode in response to the continuous operation mode and the pulse operation mode being performed in the defrost operation mode to be later than the cooling power supply time point according to a normal cooling operation mode in response to the defrost heater being only continuously turned on in the defrost operation mode. Accordingly, it may be possible to improve the defrosting efficiency and reduce the power consumption. Accordingly, it may be possible to improve the defrosting efficiency and power consumption in response to the continuous operation mode and the pulse operation mode being performed in the defrost operation mode.

A refrigerator according to an further another embodiment of the present disclosure includes: an evaporator configured to perform heat exchange; a defrost heater configured to operate to remove frost formed on the evaporator; a temperature sensor configured to detect a temperature associated with the evaporator; and a controller configured to control the defrost heater, wherein, in response to a defrosting operation start time point arriving, the controller is configured to perform a defrost operation mode, perform a continuous operation mode, in which the defrost heater is continuously turned on, and a pulse operation mode, in which the defrost heater is repeatedly turned on and off based on the defrost operation mode, and control a size of a second section related to temperature versus time between a phase-change temperature and the defrost end temperature in response to the continuous operation mode and the pulse operation mode being performed in the defrost operation mode to be greater than a size of a first section related to temperature versus time between the phase-change temperature and the defrost end temperature in response to the defrost heater being only continuously turned on in the defrost operation mode. Accordingly, since the defrosting may be performed based on the temperature change rate, it may be possible to improve defrosting efficiency and power consumption.

In particular, since the defrosting is performed according to the amount of frost of the actual evaporator, it may be possible to improve defrosting efficiency and power consumption.

DETAILED DESCRIPTION

Hereinafter, the present disclosure will be described in further detail with reference to the accompanying drawings.

The suffixes "module" and "unit" in elements used in the description below are given in consideration of ease in preparation of the specification and do not have specific meanings or functions. Therefore, the suffixes "module" and "unit" may be used interchangeably.

Figure 1:
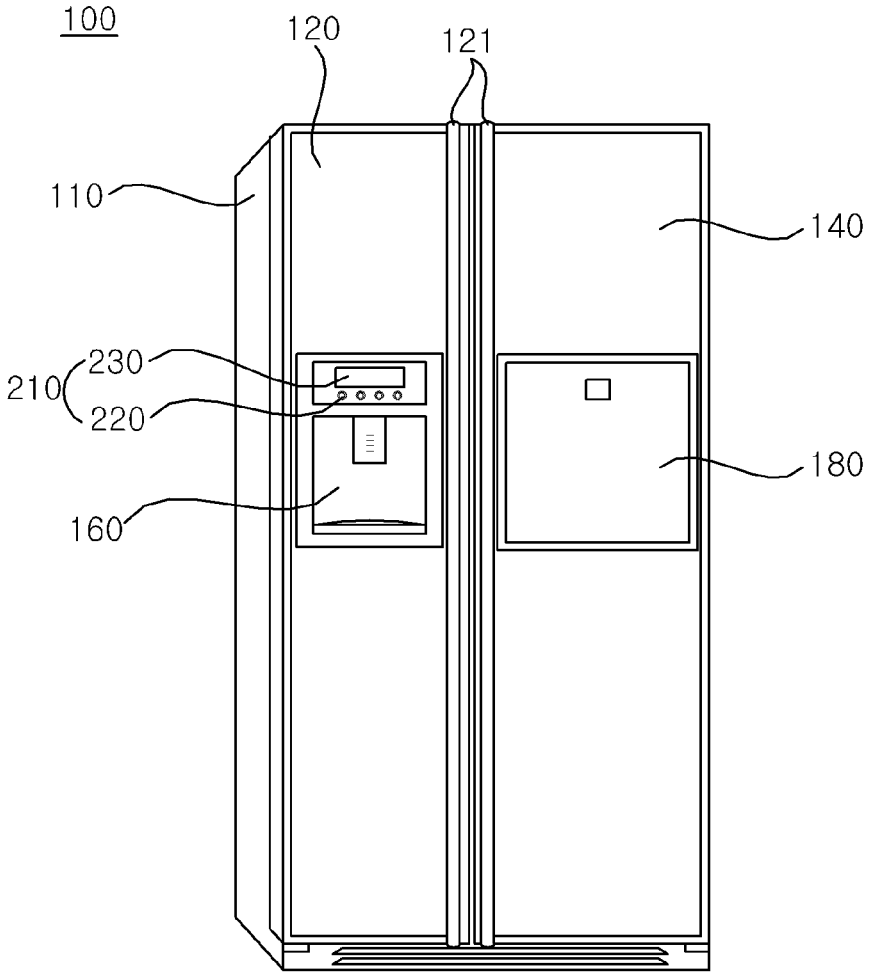
FIG. 1 is a perspective view illustrating a refrigerator according to an embodiment of the present disclosure.

FIG. 1 is a perspective view illustrating a refrigerator according to an embodiment of the present disclosure.

Referring to the drawings, a refrigerator 100 according to an embodiment of the present disclosure forms an outer shape by a case 110 having an internal space divided into a freezer compartment and a refrigerating compartment, a freezer compartment door 120 that closes the freezer compartment, and a refrigerator door 140 that closes the refrigerating compartment.

In addition, the front surface of the freezer compartment door 120 and the refrigerating compartment door 140 are further provided with door handles 121 protruding forward, so that a user may easily grip and open the freezer compartment door 120 and the refrigerating compartment door 140.

Meanwhile, the front surface of the refrigerating compartment door 140 may be further provided with a home bar 180 which is a convenient means for allowing the user to take out a stored item such as a beverage contained therein without opening the refrigerating compartment door 140.

In addition, the front surface of the freezer compartment door 120 may be provided with a dispenser 160 which is a convenient means for allowing the user to easily take out ice or drinking water without opening the freezer compartment door 120, and a control panel 210 for controlling the driving operation of the refrigerator 100 and displaying the state of the refrigerator 100 being operated on a screen may be further provided at an upper side of the dispenser 160.

Meanwhile, in the drawing, it is illustrated that the dispenser 160 is disposed in the front surface of the freezer compartment door 120, but it is not limited thereto, and may be disposed in the front surface of the refrigerating compartment door 140.

The control panel 210 may include an input device 220 having a plurality of buttons, and a display device 230 for displaying a control screen, an operation state, and the like.

The display device 230 displays information such as a control screen, an operation state, a temperature inside the refrigerator, and the like. For example, the display device 230 may display the set temperature of the freezer compartment and the set temperature of the refrigerating compartment.

The display device 230 may be implemented in various ways, such as a liquid crystal display (LCD), a light emitting diode (LED), an organic light emitting diode (OLED), and the like. In addition, the display device 230 may be implemented as a touch screen capable of serving as the input device 220.

The input device 220 may include a plurality of operation buttons. For example, the input device 220 may include a freezer compartment temperature setting button for setting the freezer compartment temperature, and a refrigerating compartment temperature setting button for setting the refrigerating compartment temperature. Meanwhile, the input device 220 may be implemented as a touch screen that may also function as the display device 230.

It should be understood that the refrigerator according to an embodiment of the present disclosure is not limited to a double door type shown in the drawing, but may be a one door type, a sliding door type, a curtain door type, and the like.

Figure 2:
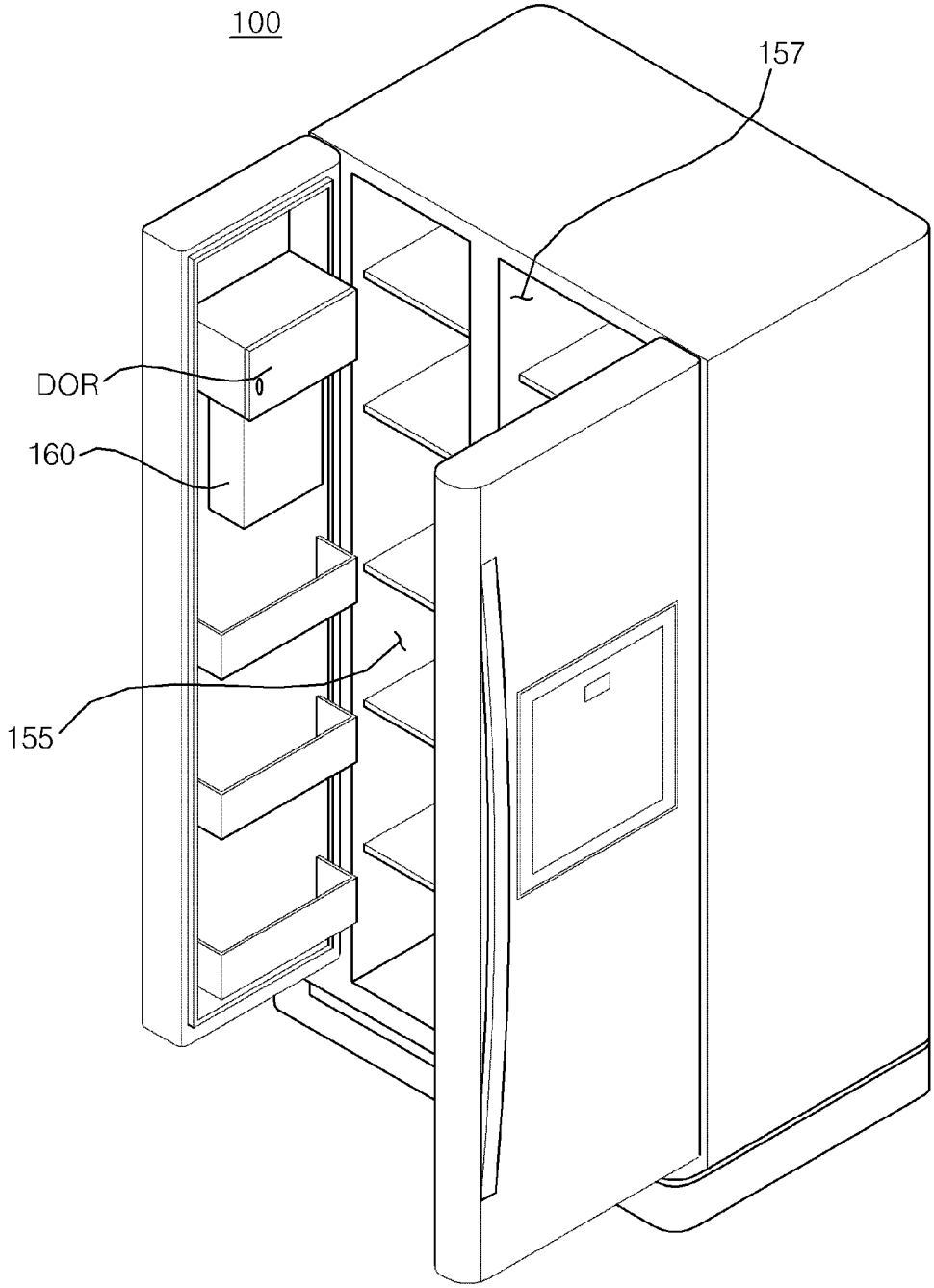
FIG. 2 is a perspective view of the refrigerator of FIG. 1 with doors open.

FIG. 2 is a perspective view of the refrigerator of FIG. 1 with the doors open.

Referring to the drawing, a freezer compartment 155 is disposed inside the freezer compartment door 120, and a refrigerating compartment 157 is disposed inside the refrigerating compartment door 140.

Figure 3:
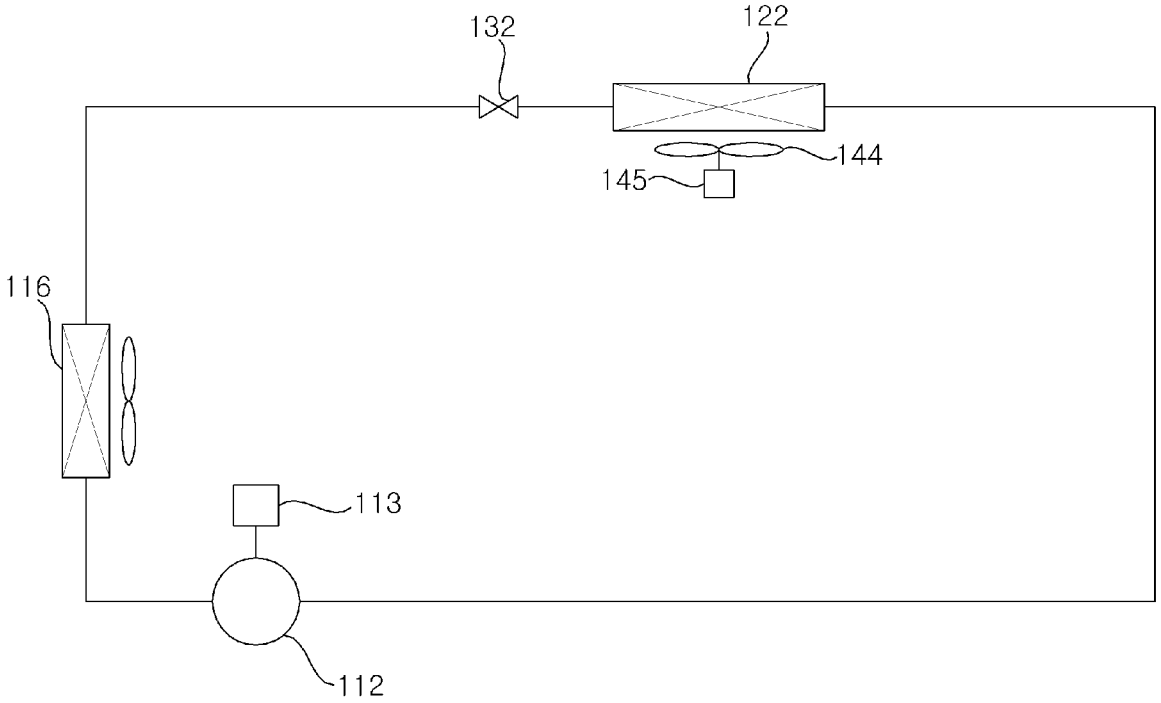
FIG. 3 is a diagram schematically illustrating a configuration of the refrigerator of FIG. 1.

FIG. 3 is a diagram schematically illustrating a configuration of the refrigerator of FIG. 1.

Referring to the drawing, the refrigerator 100 may include a compressor 112, a condenser 116 for condensing a refrigerant compressed by the compressor 112, a freezer compartment evaporator 122 which is supplied with the refrigerant condensed in the condenser 116 to evaporate, and is disposed in the freezer compartment, and a freezer compartment expansion valve 132 for expanding the refrigerant supplied to the freezer compartment evaporator 122.

Meanwhile, in the drawing, it illustrated that a single evaporator is used, but it is also possible to use evaporators in the refrigerating compartment and the freezer compartment, respectively.

That is, the refrigerator 100 may further include a refrigerating compartment evaporator (not shown) disposed in a refrigerating compartment (not shown), a three-way valve (not shown) for supplying the refrigerant condensed in the condenser 116 to the refrigerating compartment evaporator (not shown) or the freezer compartment evaporator 122, and a refrigerating compartment expansion valve (not shown) for expanding the refrigerant supplied to the refrigerating compartment evaporator (not shown).

In addition, the refrigerator 100 may further include a gas-liquid separator (not shown) which separates the refrigerant passed through the evaporator 122 into a liquid and a gas.

In addition, the refrigerator 100 may further include a refrigerating compartment fan (not shown) and a freezer compartment fan 144 that suck cold air generated through the freezer compartment evaporator 122 and blow the sucked cold air into a refrigerating compartment (not shown) and a freezer compartment (not shown), respectively.

In addition, the refrigerator 100 may further include a compressor driver 113 for driving the compressor 112, and a refrigerating compartment fan driver (not shown) and a freezer compartment fan driver 145 for driving the refrigerating compartment fan (not shown) and the freezer compartment 144, respectively.

Meanwhile, based on the drawing, since a common evaporator 122 is used for the refrigerating compartment and the freezer compartment, in this case, a damper (not shown) may be installed between the refrigerating compartment and the freezer compartment, and a fan (not shown) may forcibly blow the cold air generated in one evaporator to be supplied to the freezer compartment and the refrigerating compartment.

Figure 4:
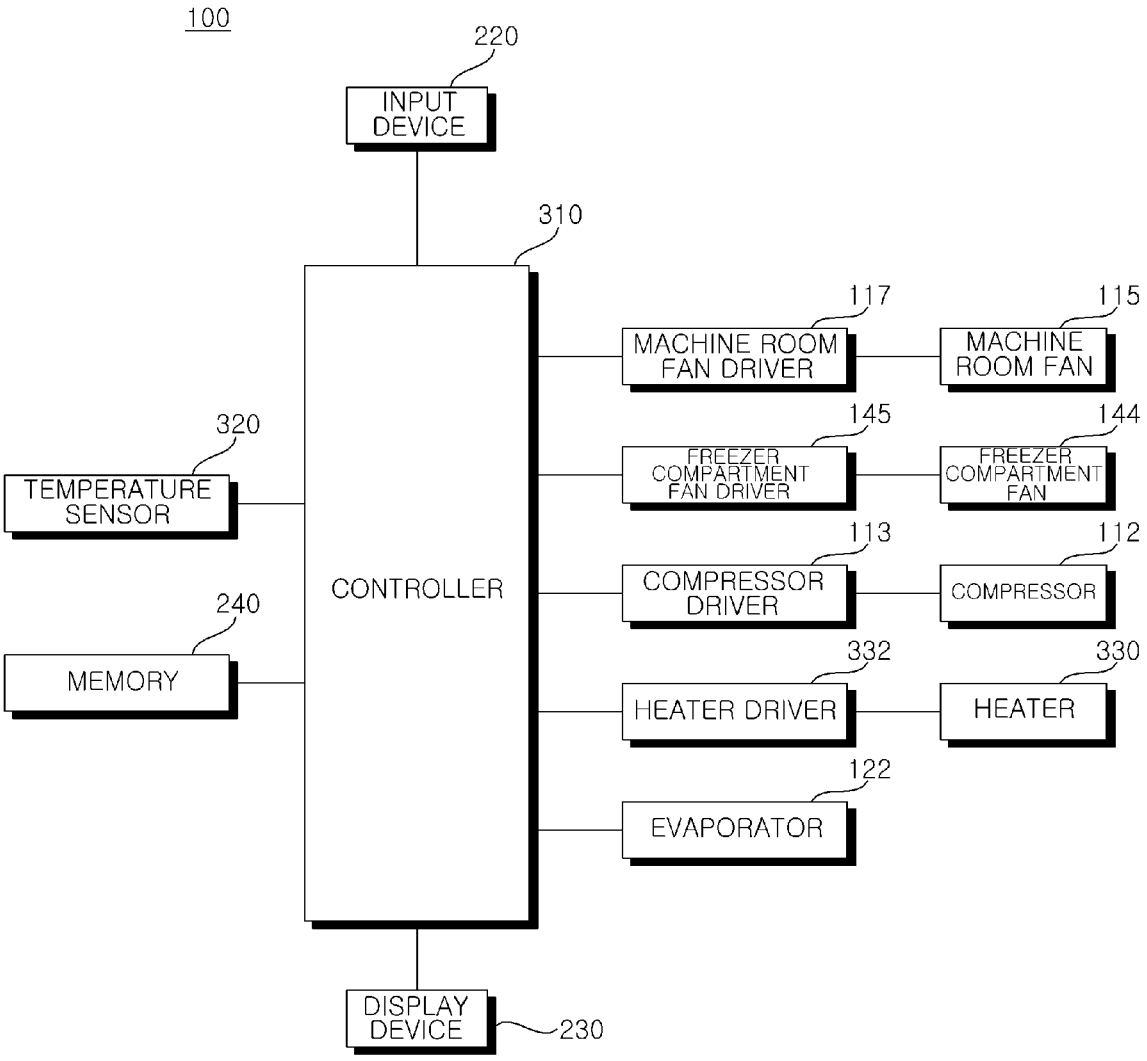
FIG. 4 is a block diagram schematically illustrating components of the refrigerator shown in FIG. 1.

FIG. 4 is a block diagram schematically illustrating components of the refrigerator shown in FIG. 1.

Referring to the drawings, the refrigerator of FIG. 4 includes the compressor 112, a machine room fan 115, the freezer compartment fan 144, a controller 310, a heater 330, a temperature sensor 320, a memory 240, and an evaporator 122. The controller 310 may be a microprocessor, a logic electrical circuit, an integrated circuit, and the like.

In addition, the refrigerator may further include a compressor driver 113, a machine room fan driver 117, a freezer compartment fan driver 145, a heater driver 332, a display device 230, and an input device 220.

The compressor 112, the machine room fan 115, and the freezer compartment fan 144 are described with reference to FIG. 2.

The input device 220 includes a plurality of operation buttons, and transmits a signal for an input freezer compartment set temperature or refrigerating compartment set temperature to the controller 310.

The display device 230 may display an operation state of the refrigerator. Meanwhile, the display device 230 is operable under the control of a display controller (not shown) The memory 240 may store data necessary for operating the refrigerator.

For example, the memory 240 may store power consumption information for each of the plurality of power consumption devices. In addition, the memory 240 may output corresponding power consumption information to the controller 310 based on the operation of each power consumption device in the refrigerator.

The temperature sensor 320 detects a temperature in the refrigerator and transmits a signal for the detected temperature to the controller 310. Here, the temperature sensor 320 detects the refrigerating compartment temperature and the freezer compartment temperature respectively. In addition, the temperature of each chamber in the refrigerating compartment or each chamber in the freezer compartment may be detected.

In order to control an ON/OFF operation of the compressor 112, the fan 115 or 144, and the heater 330, as shown in the drawing, the controller may control the compressor driver 113, the fan driver 117 or 145, and the heater driver 332 to control the compressor 112, the fan 115 or 144, and the heater 330, respectively. Here, the fan driver may be the machine room fan driver 117 or the freezer compartment fan driver 145.

For example, the controller 310 may output a corresponding speed command value signal to the compressor driver 113 or the fan driver 117 or 145, respectively.

The compressor driver 113 and the freezer compartment fan driver 145 described above are provided with a compressor motor (not shown) and a freezer compartment fan motor (not shown) respectively, and each motor (not shown) may be operated at a target rotational speed under the control of the controller 310.

Meanwhile, the machine room fan driver 117 includes a machine room fan motor (not shown), and the machine room fan motor (not shown) may be operated at a target rotational speed under the control of the controller 310.

When the motor is a three-phase motor, it may be controlled by a switching operation of an inverter (not shown) or may be controlled at a constant speed by using an AC power source. Each motor may be any one of an induction motor, a Blush less DC (BLDC) motor, a synchronous reluctance motor (synRM) motor, and the like.

Meanwhile, as described above, the controller 310 may control the overall operation of the refrigerator 100, in addition to the operation control of the compressor 112 and the fan 115 or 144.

For example, as described above, the controller 310 may control the overall operation of the refrigerant cycle based on the set temperature from the input device 220. For example, the controller 310 may further control a three-way valve (not shown), a refrigerating compartment expansion valve (not shown), and a freezer compartment expansion valve 132, in addition to the compressor driver 113, the refrigerating compartment fan driver (not shown), and the freezer compartment fan driver 145. In addition, the operation of the condenser 116 may also be controlled. In addition, the controller 310 may control the operation of the display device 230.

Meanwhile, the cold air heat-exchanged at the evaporator 122 may be supplied to the freezer compartment or the refrigerating compartment by a fan or a damper (not shown).

Meanwhile, the heater 330 may be a freezer compartment defrost heater. For example, when only one freezer compartment evaporator 122 is used in the refrigerator 100, the freezer compartment defrost heater 330 may operate to remove frost attached to the freezer compartment evaporator 122. To this end, the heater driver 332 may control the operation of the heater 330. Meanwhile, the controller 310 may control the heater driver 332.

The heater 330 may include a freezer compartment defrost heater and a refrigerating compartment defrost heater. For example, when the freezer compartment evaporator 122 and the refrigerating compartment evaporator (not shown) are separately used in the refrigerator 100, the freezer compartment defrost heater 330 may operates to remove frost attached to the freezer compartment evaporator 122, and the refrigerating compartment defrost heater (not shown) may operate to remove frost attached to the refrigerating compartment evaporator. To this end, the heater driver 332 may control the operations of the freezer compartment defrost heater 330 and the refrigerating compartment defrost heater.

Figure 5A:
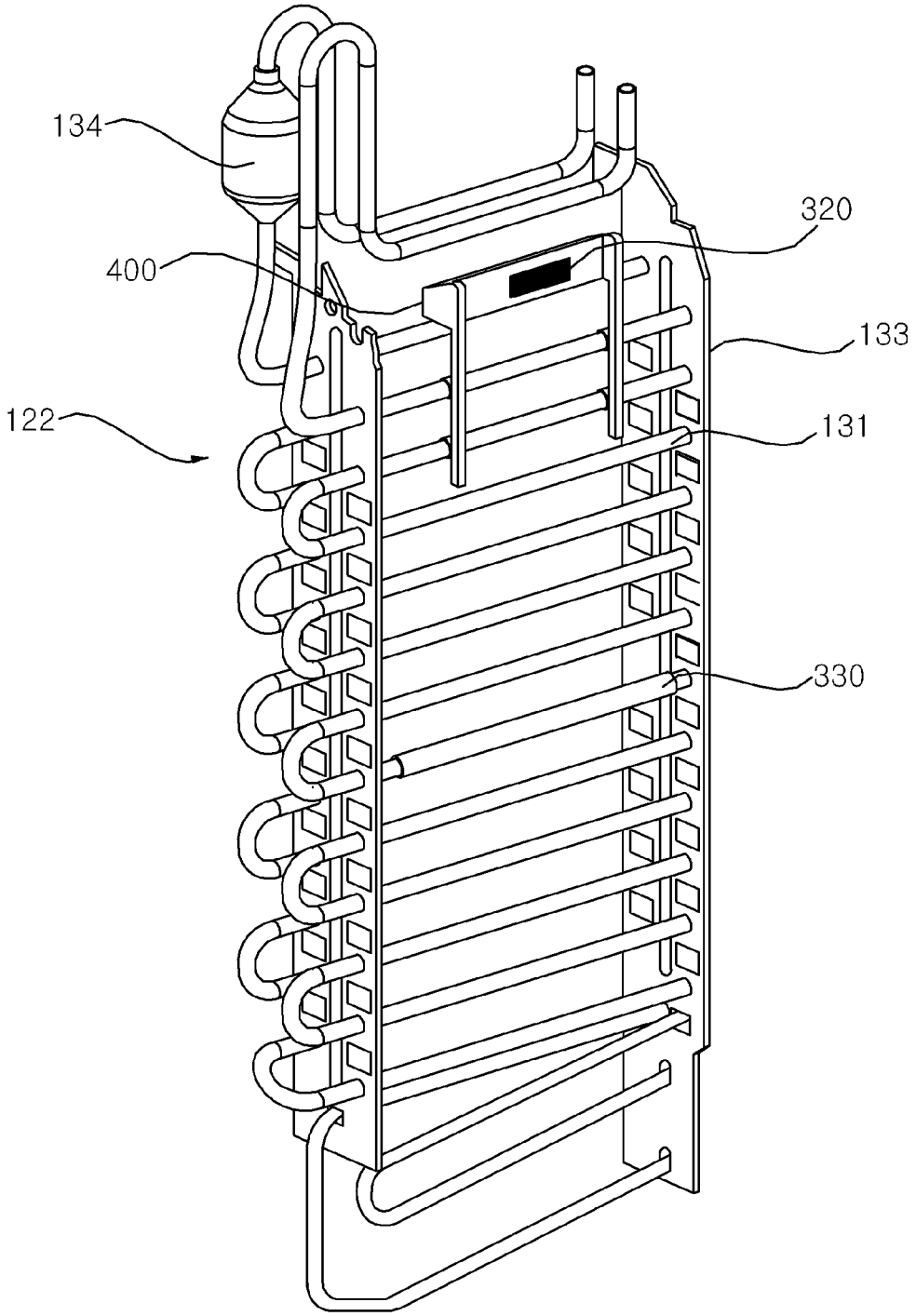
FIG. 5A is a perspective view illustrating an example of an evaporator associated with the present disclosure.
Figure 5B:
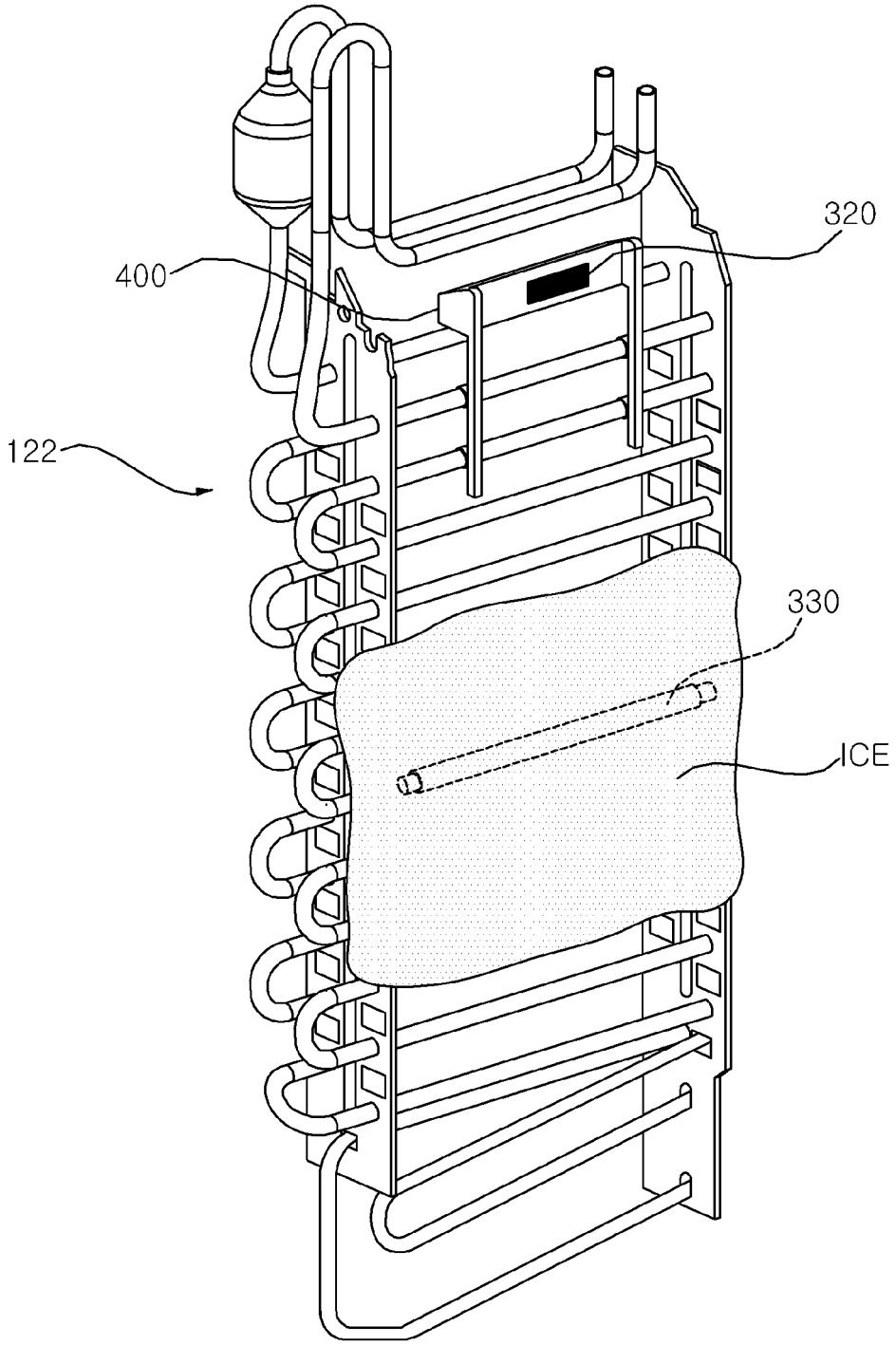
FIG. 5B is a perspective view illustrating frost ICE on the evaporator referenced in the description of FIG. 5A.

FIG. 5A is a perspective view illustrating an example of an evaporator related to the present disclosure, and FIG. 5B is a perspective view illustrating frost ICE on the evaporator referenced in FIG. 5A.

Referring to FIG. 5A, the evaporator 122 in the refrigerator 100 may be a freezer compartment evaporator as described above with reference to FIG. 3.

A sensor mounter 400 including a temperature sensor 320 may be attached to the evaporator 122 in the refrigerator 100.

In the drawing, it is illustrated that a sensor mounter 400 is attached to an upper cooling pipe of the evaporator 122 in the refrigerator 100.

The evaporator 122 includes a cooling pipe 131 extending from one side of the accumulator 134 and a support 133 supporting the cooling pipe 131.

The cooling pipe 131 may be repeatedly bent in a zigzag manner to form multiple rows and may be filled with a refrigerant.

Meanwhile, the defrost heater 330 for defrosting may be disposed in the vicinity of the cooling pipe 131 of the evaporator 122.

In the drawing, it is illustrated that the defrost heater 330 is disposed in the vicinity of the cooling pipe 131 in a lower region of the evaporator 122.

For example, since frost ICE is usually formed from a lower region of the evaporator 122 and grows in an upward direction, preferably, the defrost heater 330 may be disposed in the vicinity of the cooling pipe 131 in the lower region of the evaporator 122.

Accordingly, as shown in the drawing, the defrost heater 330 may be disposed in a shape surrounding the cooling pipe 131 of the lower region of the evaporator 122.

Meanwhile, FIG. 5B illustrates frost ICE attached to the evaporator 122.

In the drawing, it is illustrated that frost ICE is attached to a central portion and a lower portion of the evaporator 122.

In particular, in the drawing, it is illustrated that frost ICE is formed on the defrost heater 330 to cover the defrost heater 330.

When the defrost heater 330 operates, frost ICE may be removed from the lower region of the evaporator 122 and may be gradually removed in the direction of the central region.

Meanwhile, in the present disclosure, a method for improving defrosting efficiency and power consumption when removing frost ICE, that is, defrosting, is proposed. This will be described with reference to FIG. 6 and the following drawings.

Figure 6:
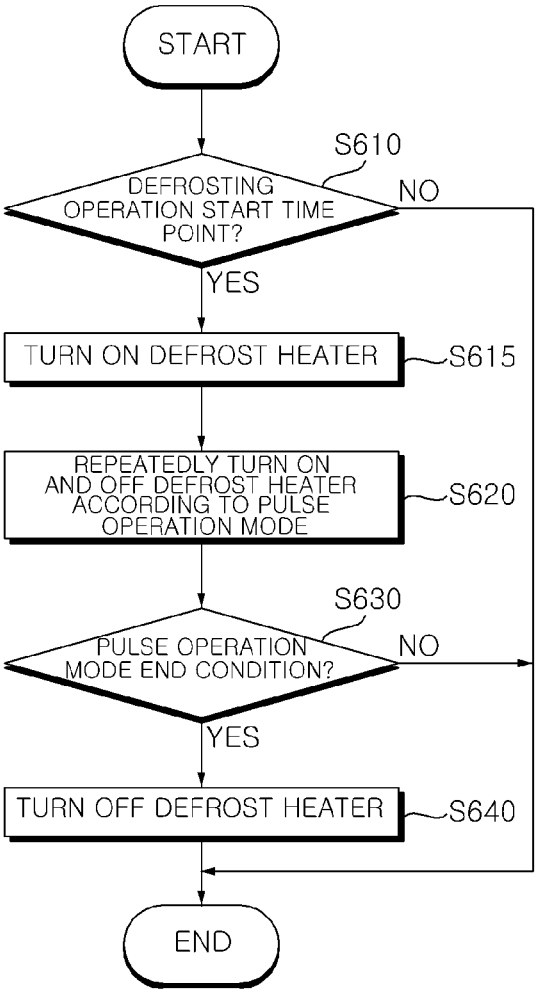
FIG. 6 is a flowchart illustrating a method of operating a refrigerator according to an embodiment of the present disclosure.

FIG. 6 is a flowchart illustrating a method of operating a refrigerator according to an embodiment of the present disclosure.

Referring to the drawings, the controller 310 of the refrigerator 100 according to an embodiment of the present disclosure determines whether a defrosting operation start time point for defrosting has arrived (S610).

Figure 8A:
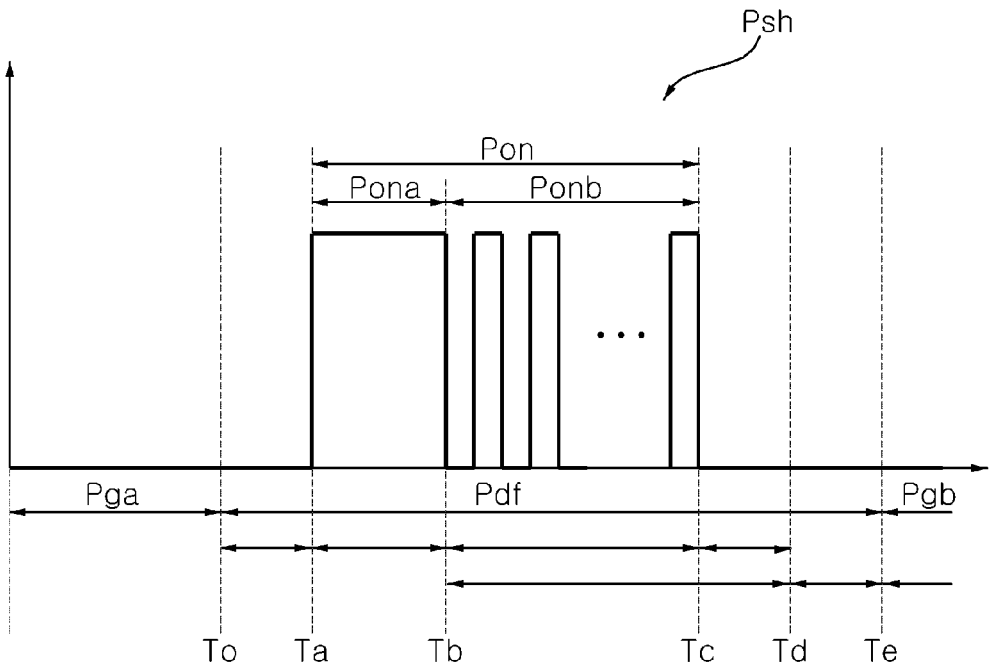

For example, the controller 310 of the refrigerator 100 may determine whether a defrosting operation start time point has arrived while performing a normal cooling operation mode Pga (see for example, FIG. 8A).

The defrosting operation start time point may vary according to a defrost cycle.

For example, when the number of opening times a door of the cooling compartment (the refrigerating compartment or the freezer compartment) increases, the amount of cold air supplied in the normal cooling operation mode increases, and accordingly, a rate at which frost is formed on the evaporator 122 may also increase.

Accordingly, when the number of opening times of the door of the cooling compartment (the refrigerating compartment or the freezer compartment) increases, the controller 310 of the refrigerator 100 may control such that a defrost cycle is shortened.

That is, when the number of opening times of the door of the cooling compartment (the refrigerating compartment or the freezer compartment) increases, the controller 310 of the refrigerator 100 may control the defrosting operation start time point to be shortened.

Meanwhile, when a defrosting operation start condition is satisfied, for example, in response to a defrosting operation start time point arriving, the controller 310 of the refrigerator 100 may end the normal cooling operation mode, control to perform a defrost operation mode Pdf, and control the defrost heater 330 to be continuously turned on based on a heater operation mode PddT in the defrost operation mode Pdf (S615).

Next, the controller 310 of the refrigerator 100 may control to perform a pulse operation mode in which the defrost heater 330 is repeatedly turned on and off by a heater pulse after the defrost heater 330 is continuously turned on (S620).

For example, when the defrost operation start condition is satisfied, the controller 310 of the refrigerator 100 may control to perform the defrost operation mode Pdf including a pre-defrost cooling mode Pbd, a heater operation mode PddT, and a post-defrost cooling mode pbf.

Also, based on the heater operation mode PddT, and based on the defrost operation mode pdf, the controller may control to perform a continuous operation mode Pona in which the defrost heater 330 is continuously turned on and a pulse operation mode Ponb in which the defrost heater 330 is repeatedly turned on and off.

Meanwhile, the controller 310 controls the defrost heater 330 to be continuously turned on based on the continuous operation mode Pona, and in the ON state of the defrost heater 330, when a change rate of an ambient temperature of the evaporator 122 detected by the temperature sensor 320 is equal to or greater than a first reference value ref1, the controller 310 may enter the pulse operation mode Ponb to control the defrost heater 330 to be turned off. Accordingly, defrosting efficiency and power consumption may be improved.

Meanwhile, the controller 310 of the refrigerator 100 may control the defrost heater 330 to be turned on and off based on a change rate of the temperature detected by the temperature sensor 320 when the pulse operation mode Ponb is performed.

For example, in response to performing the pulse operation mode Ponb, if the change rate of the temperature detected by the temperature sensor 320 is equal to or greater than the first reference value ref1, the controller 310 of the refrigerator 100 may control the defrost heater 330 to be turned off, and if the change rate of the temperature detected by the temperature sensor 320 is less than or equal to a second reference value ref2, which is less than the first reference value ref1, the controller 310 may control the defrost heater 330 to be turned on. Accordingly, since defrosting may be performed based on a change rate ΔT of the temperature, defrosting efficiency and power consumption may be improved.

Next, the controller 310 of the refrigerator 100 determines whether a pulse operation mode end time point has arrived (S630), and if pulse operation mode end time point has arrived, the controller 310 turns off the defrost heater 330 (S640).

For example, the pulse operation mode end time point may be a time point at which the temperature detected by the temperature sensor 320 falls below a phase-change temperature Trf1.

As another example, the pulse operation mode end time point may be an end time point of the defrosting operation or an end time point of the heater operation mode.

As such, the continuous operation mode Pona in which the defrost heater 330 is continuously turned on and the pulse operation mode in which the defrost heater 330 is repeatedly turned on and off are controlled to be performed based on the change rate of the temperature detected by the temperature sensor 320, and the defrosting efficiency and power consumption may be improved by performing defrosting based on the change rate ΔT of the temperature.

In particular, since defrosting is performed according to the actual amount of frost on the evaporator 122, defrosting efficiency and power consumption may be improved.

FIGS. 7A to 13 are diagrams referenced in the description of FIG. 6.

Figure 7A:
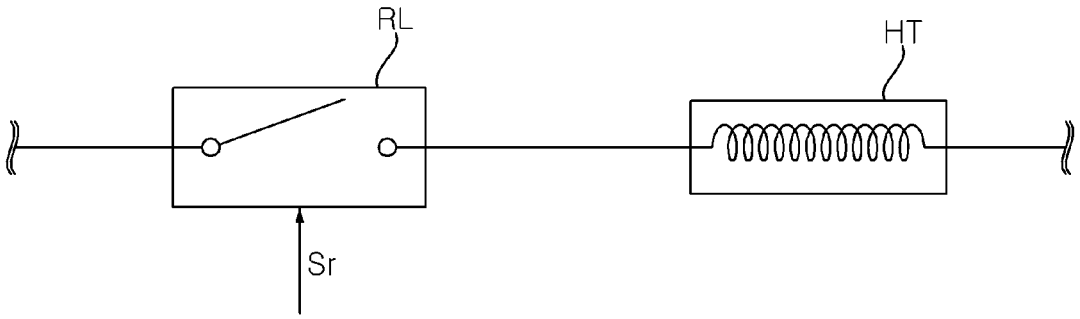
FIGS. 7A to 13 are diagrams referenced in the description of FIG. 6.

FIG. 7A is a diagram illustrating a defrost heater HT and a switching element RL for driving a defrost heater when one evaporator and one defrost heater are used in the refrigerator 100.

Referring to the drawing, when only one freezer compartment evaporator 122 is used in the refrigerator 100, the freezer compartment defrost heater HT may operate to remove frost attached to the freezer compartment evaporator 122.

To this end, the switch RL in the heater driver 332 may control the operation of the defrost heater HT. In this case, the switch RL may be a relay.

That is, when the switch RL is continuously turned on, the continuous operation mode Pona in which the defrost heater HT is continuously turned on may be performed, and when the switch RL is switched on and off, the pulse operation mode Ponb in which the defrost heater HT is repeatedly turned on and off may be performed.

Figure 7B:
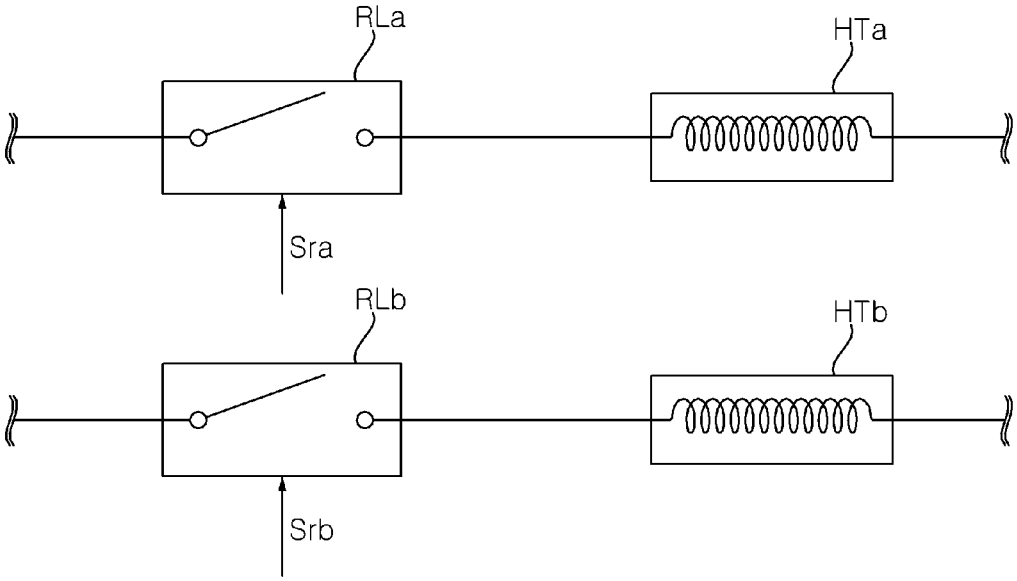

Next, FIG. 7B is a diagram illustrating defrost heaters HTa and HTb and switches RLa and Rlb for driving the defrost heaters when two evaporators and two defrost heaters are used in the refrigerator 100.

When a first defrost heater HTa is a freezer compartment defrost heater, a first switch RLa in the heater driver 332 may control the operation of the first defrost heater HTa. In this case, the first switch RLa may be a relay.

That is, when the first switch RLa is continuously turned on, the continuous operation mode Pona in which the first defrost heater HTa is continuously turned on may be performed, and when the first switch RLa performs on and off switching, the pulse operation mode Ponb in which the first defrost heater HTa is repeatedly turned on and off may be performed.

When a second defrost heater HTb is a refrigerating compartment defrost heater, a second switch RLb in the heater driver 332 may control the operation of the second defrost heater HTb. In this case, the second switch RLb may be a relay.

That is, when the second switch RLb is continuously turned on, the continuous operation mode Ponb in which the second defrost heater HTb is continuously turned on may be performed, and when the second switch RLb performs on and off switching, the pulse operation mode Ponb in which the second defrost heater HTb is repeatedly turned on and off may be performed.

Meanwhile, on and off timings of the first switch RLa and the second switch RLb may be different from each other. Accordingly, it may be possible to perform the defrosting of the freezer compartment evaporator and the defrosting of the refrigerating compartment evaporator, separately.

FIG. 8A is a diagram illustrating an example of a pulse waveform indicating an operation of one defrost heater of FIG. 7A.

Referring to the drawings, the horizontal axis of the pulse waveform Psh may represent time and the vertical axis may represent a level.

When the defrosting start time To arrives, while performing the normal cooling operation mode Pga, the controller 310 of the refrigerator 100 may end the normal cooling operation mode Pga and control to perform the defrost operation mode pdf.

The defrost operation mode pdf may include a pre-defrost cooling mode Pbd between To and Ta, a heater operation mode PddT between Ta and Td, and a post-defrost cooling mode pbf between Td and Te.

Meanwhile, after the defrost operation mode pdf is ended, the normal cooling operation mode Pgb is performed again.

The defrost heater 330 is turned off in the normal cooling operation mode Pga and the normal cooling operation mode Pgb.

Meanwhile, the defrost heater 330 may be turned off in the pre-defrost cooling mode Pbd and the post-defrost cooling mode pbf of the defrost operation mode Pdf.

Meanwhile, the defrost heater 330 may be continuously turned on in the continuous operation mode Pona of the heater operation mode PddT, and may be repeatedly turned on and off in the pulse operation mode Ponb of the heater operation mode PddT.

The continuous operation mode Pona may be performed between Ta and Tb, and the pulse operation mode Ponb may be performed between Tb and Tc.

When only the continuous operation mode is performed and the defrost heater 330 is continuously turned on, if the amount of frost is large, defrosting may not be performed properly or if the amount of frost is small, unnecessary defrosting may be performed, and thus, unnecessary power consumption may be consumed.

Accordingly, in the present disclosure, the continuous operation mode Pona and the pulse operation mode Ponb are used in combination. Accordingly, defrosting efficiency and power consumption may be improved.

Figure 8B:
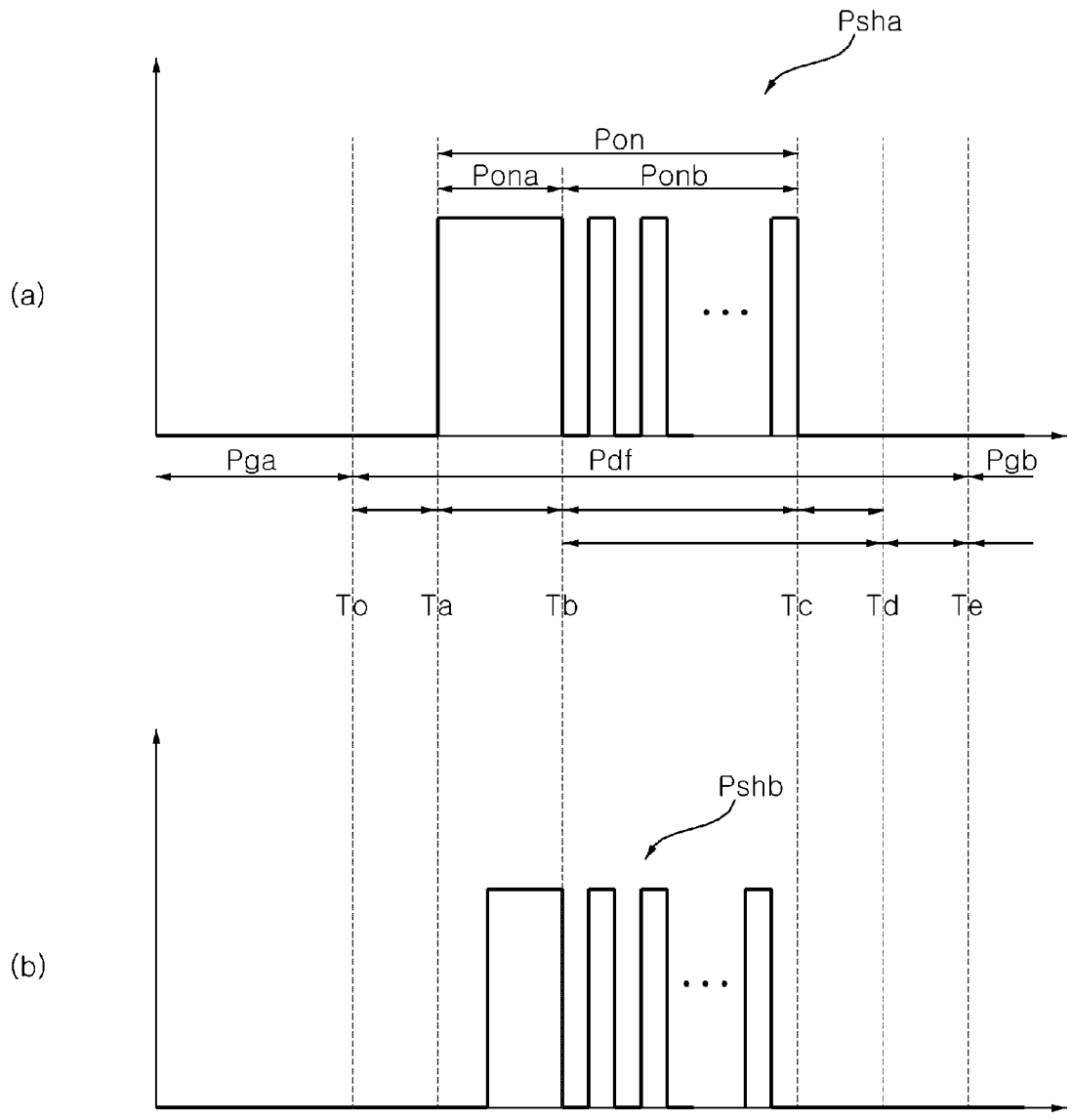

FIG. 8B is a diagram illustrating an example of a pulse waveform indicating an operation of two defrost heaters of FIG. 7B.

Referring to the drawing, (a) of FIG. 8B shows a pulse waveform Psha indicating an operation of the freezer compartment defrost heater, and (b) of FIG. 8B shows a pulse waveform Pshb indicating an operation of the refrigerating compartment defrost heater.

The pulse waveform Psha of (a) of FIG. 8B may be the same as the pulse waveform Psh of FIG. 8A.

Meanwhile, since less frost may occur in the refrigerating compartment evaporator than in the freezer compartment evaporator, an operating section of the refrigerating compartment defrost heater may be less than an operating section of the freezer compartment defrost heater.

Referring to the pulse waveform Pshb of (b) of FIG. 8B, a period of continuously turning on in the continuous operation mode Pona in the heater operation mode PddT may be less than that of a corresponding period of continuously turning on in the pulse waveform Psha of (a) of FIG. 8B.

In addition, referring to the pulse waveform Pshb of (b) of FIG. 8B, an ON/OFF repetition period of the pulse operation mode Ponb in the heater operation mode PddT may be less than that of a corresponding ON/OFF repetition period in the pulse waveform Psha of (a) of FIG. 8B.

Figure 9:
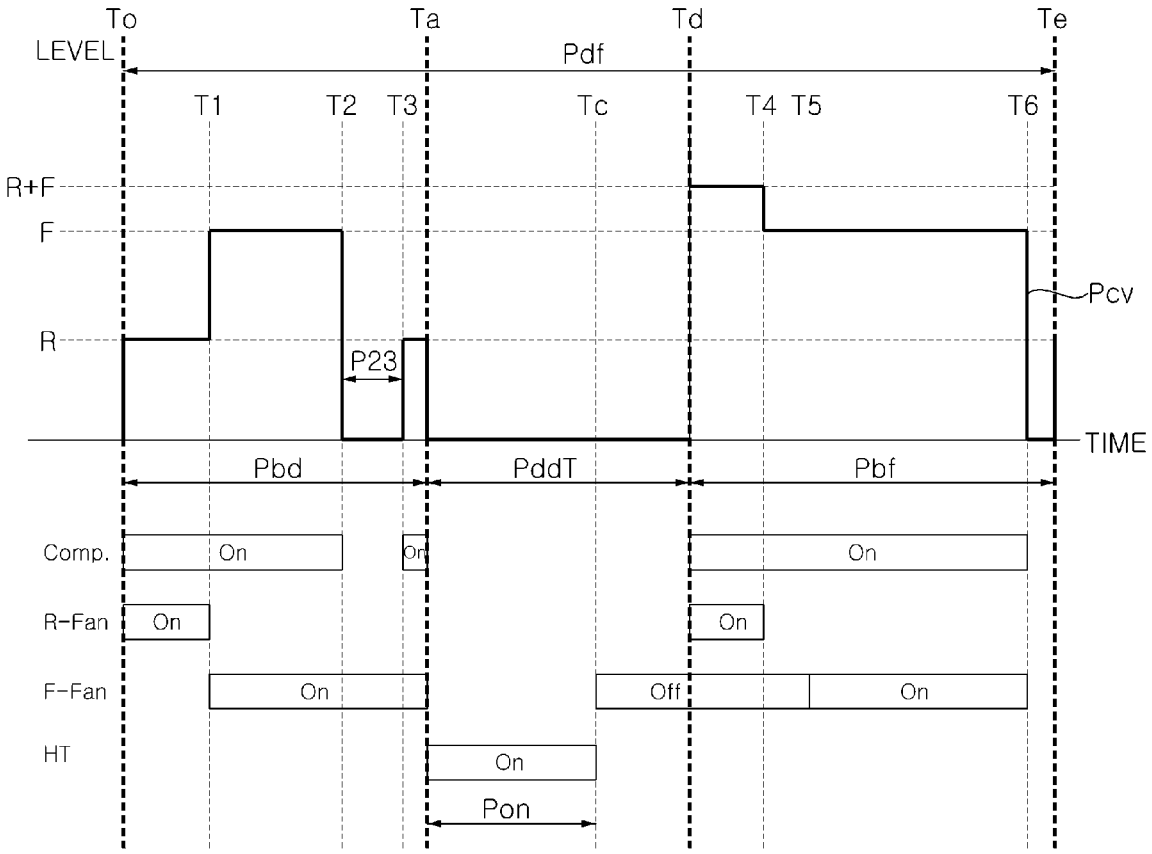

FIG. 9 is a diagram illustrating an example of cooling power supply and a defrost heater operation in the defrost operation mode Pdf of FIG. 8A.

Referring to the drawing, the defrost operation mode pdf may include a pre-defrost cooling mode Pbd between To and Ta, a heater operation mode PddT between Ta and Td, and a post-defrost cooling mode pbf between Td and Te.

During a period To to T1 of the pre-defrost cooling mode Pbd, a level of supplied cooling power may be an R level, and during a period T1 to T2, a level of supplied cooling power may be an F level that is greater than the R level.

Also, during a period T2 to T3 of the pre-defrost cooling mode Pbd, the cooling power supply may be stopped.

In addition, during a period T3 to Ta in the pre-defrost cooling mode Pbd, a level of supplied cooling power may be the R level.

According to the pre-defrost cooling mode Pbd, the supplied cooling power to compensate for the stoppage of cooling power supply during the heater operation mode PddT is performed.

Meanwhile, the cooling power supply may be performed by a compressor, a thermoelectric element, or the like, and in the drawings, it is illustrated that the cooling power supply is performed by an operation of the compressor.

During a period To to T2 and T3 to Ta in which the cooling power is supplied, the compressor operates, and during a period T2 to T3 in which the cooling power is not supplied, the compressor is turned off.

Meanwhile, during a period To to T1 in which the cooling power of R level is supplied, the refrigerating compartment fan may operate and the freezer compartment fan may be turned off.

Meanwhile, during a period from a time point T1, at which the cooling power of F level is supplied, to a time point Ta, at which the pre-defrost cooling mode Pbd is ended, the refrigerating compartment fan may be turned off and the freezer compartment fan may be operated.

Meanwhile, during the period T2 to Ta, the defrost heater 330 may be maintained in an OFF state.

Next, the defrost heater 330 may operate during the period of Ta to Tc in the period of Ta to Td of the heater operation mode PddT.

As shown in FIG. 8A, the continuous operation mode Pona may be performed during the period of Ta to Tb of the heater operation mode PddT period, and the heater operation mode PddT may be performed during the period starting at Tb and the period starting at Tc.

Meanwhile, the defrost heater 330 may be turned off from Tc, which is an end time point of the continuous operation mode Pona, to Td.

Meanwhile, during the period of the heater operation mode PddT, the compressor and the refrigerating compartment fan may be turned off.

Meanwhile, during the period of the heater operation mode PddT, the freezer compartment fan may be turned off. In particular, it is preferable that the freezer compartment fan is turned off from Tc, which is the end time point of the continuous operation mode Pona, to Td.

After the heater operation mode PddT, the post-defrost cooling mode Pbf is performed.

During the period of Td to T4 in the post-defrost cooling mode Pbf, a level of the supplied cooling power may be an R+F level, and the largest level of cooling power may be supplied.

In addition, during the period of T4 to T6 in the post-defrost cooling mode Pbf, a level of the supplied cooling power may be F level, and the cooling power supply may be stopped during the period T6 to Te.

According to the post-defrost cooling mode Pbf, the largest level of cooling power supply may be performed according to the stopping of the cooling power supply during the heater operation mode PddT.

During the period of Td to T6 in which the cooling power is supplied, the compressor operates, and the compressor is turned off during the period of T6 to Te in which the cooling power is not supplied.

Meanwhile, during the period of Td to T4 in which the cooling power of R+F level is supplied, the refrigerating compartment fan and the freezer compartment fan may be turned on together.

Meanwhile, during the period of T4 to T6 in which the cooling power of F level is supplied, the refrigerating compartment fan may be turned off and the freezer compartment fan may be operated.

Meanwhile, the level of power consumption in the heater operation mode PddT in FIG. 9 may be greater than the level of power consumption of the cooling power of R+F level.

Figure 10:
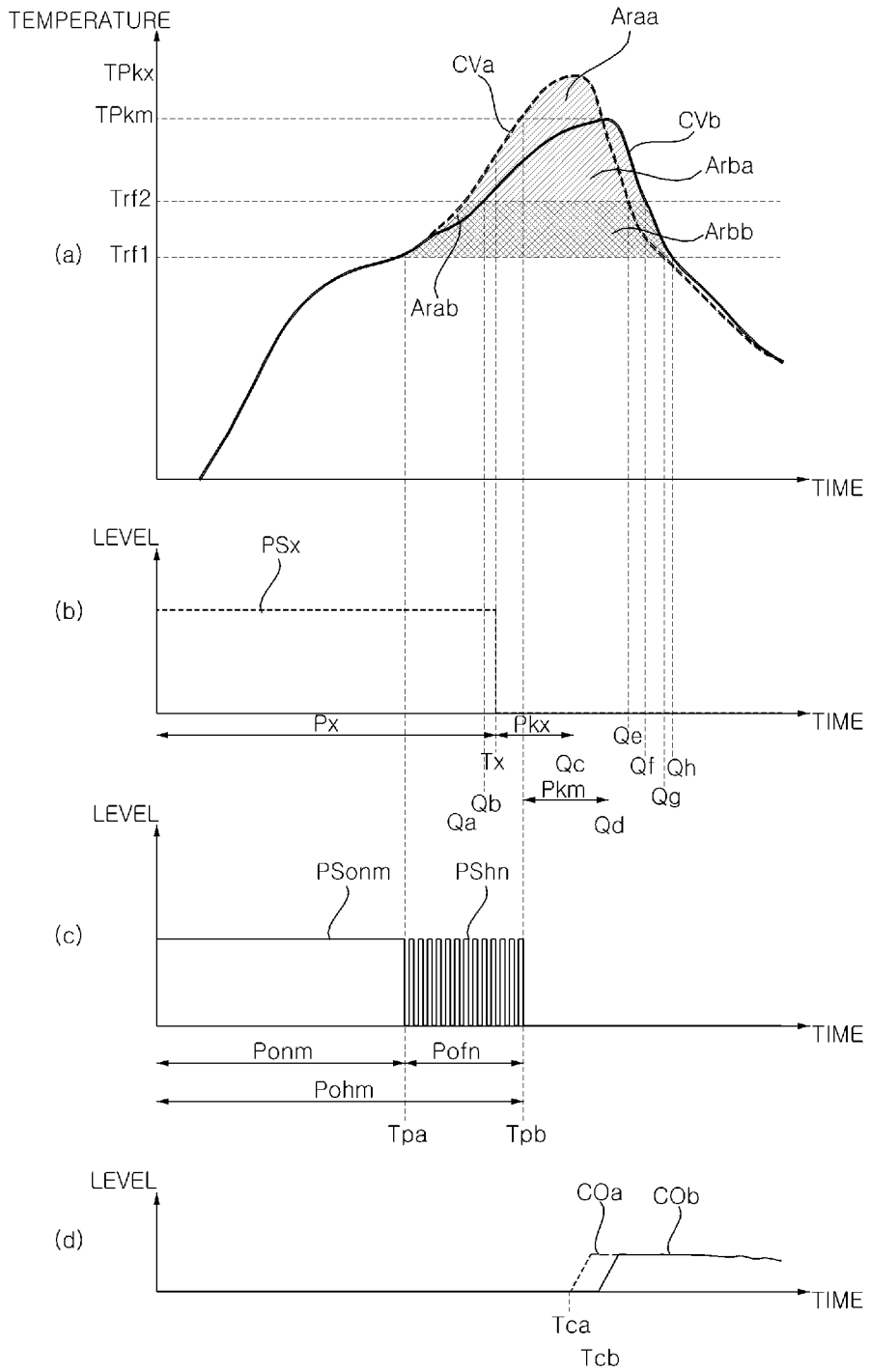

FIG. 10 is a diagram illustrating temperature change waveforms of an evaporator in response to the defrost heater being operated only in the continuous operation mode and in response to the continuous operation mode and the pulse operation mode being mixed.

In particular, in (a) of FIG. 10, CVa represents a temperature change waveform in response to the defrost heater being operated only in the continuous operation mode, and CVb represents a temperature change waveform in response to the defrost heater being operated by mixing the continuous operation mode and the pulse operation mode.

According to CVa, the defrost heater 330 is continuously turned on, and may be turned off at a time point Tx, as shown in (b) of FIG. 10.

According to CVb, the defrost heater 330 operates during the Pohm period, as shown in (c) of FIG. 10.

That is, during the Ponm period including up to a Tpa time point, the continuous operation mode is performed, and the pulse operation mode is performed during a Pofn period from Tpa to Tpb.

Trf1 represents a phase-change temperature, and may be, for example, 0° C. Meanwhile, Trf2 represents a defrost end temperature, for example, may be 5° C.

Meanwhile, a region between Trf1 and Trf2 may indicate a defrosting region in which defrosting is actually performed, and a region exceeding Trf2 may indicate an overheating region in which excessive defrosting is performed.

In order to actually effectively perform defrosting, it is preferable that a size of the overheating region is reduced and a size of the defrosting region is increased.

Accordingly, in the present disclosure, the continuous operation mode and the pulse operation mode of the defrost heater 300 are mixed in order to reduce the size of the overheating region and increase the size of the defrosting region.

Meanwhile, the controller 310 may be configured to control a peak temperature arrival point Qd of the evaporator 122, when the continuous operation mode Pona and the pulse operation mode Ponb are performed in the defrost operation mode Pdf, to be later than a peak temperature arrival point Qc of the evaporator 122, when the defrost heater 330 is only continuously turned on in the defrost operation mode Pdf. Accordingly, it may be possible to improve the defrosting efficiency and power consumption when the continuous operation mode Pona and the pulse operation mode Ponb are performed.

Meanwhile, the controller 310 may be configured to control a size of a second section Arbb related to a temperature versus time between a phase-change temperature Trf1 and a defrost end temperature Trf2 in response to the continuous operation mode and the pulse operation mode being performed in the defrost operation mode Pdf to be greater than a size of a first section Arab related to a temperature versus time between the phase-change temperature Trf1 and the defrost end temperature Trf2 in response to the defrost heater being only continuously turned on in the defrost operation mode Pdf. Accordingly, it may be possible to improve the defrosting efficiency and power consumption when the continuous operation mode Pona and the pulse operation mode Ponb are performed.

Meanwhile, the controller 310 may be configured to control an effective defrosting when the continuous operation mode Pona and the pulse operation mode Ponb are performed in the defrost operation mode Pdf that is greater than an effective defrosting when the defrost heater 330 is only continuously turned on in the defrost operation mode Pdf. Accordingly, it may be possible to improve the defrosting efficiency and power consumption when the continuous operation mode Pona and the pulse operation mode Ponb are performed.

Meanwhile, the controller 310 may be configured to control a heater OFF time point Tpb when the continuous operation mode Pona and the pulse operation mode Ponb are performed in the defrost operation mode Pdf to be later than a heater OFF time point Tx when the defrost heater 330 is only continuously turned on in the defrost operation mode Pdf. Accordingly, it may be possible to improve the defrosting efficiency and power consumption when the continuous operation mode Pona and the pulse operation mode Ponb are performed.

Meanwhile, the controller 310 may be configured to control a period Tpb-Qd between the heater OFF time point Tpb and a peak temperature arrival time Qd of the evaporator 122 when the continuous operation mode Pona and the pulse operation mode Ponb are performed in the defrost operation mode Pdf to be greater than a period Tx-Qc between the heater OFF time point and the peak temperature arrival time Qc of the evaporator 122 when the defrost heater 330 is only continuously turned on in the defrost operation mode Pdf. Accordingly, it may be possible to improve the defrosting efficiency and power consumption when the continuous operation mode Pona and the pulse operation mode Ponb are performed.

Meanwhile, the controller 310 may be configured to control a period Tpb-Qh during which a temperature maintains above the phase-change temperature Trf1 when the continuous operation mode Pona and the pulse operation mode Ponb are performed in the defrost operation mode Pdf to be greater than a period Tx-Qg during which a temperature maintains above the phase-change temperature Trf1 when the defrost heater 330 is only continuously turned on in the defrost operation mode Pdf. Accordingly, it may be possible to improve the defrosting efficiency and power consumption when the continuous operation mode Pona and the pulse operation mode Ponb are performed Meanwhile, the controller 310 may be configured to control a period Tpb-Qh between the heater OFF time point Tpb to a time point at which a temperature falls below a phase-change temperature Trf1 when the continuous operation mode Pona and the pulse operation mode Ponb are performed in the defrost operation mode Pdf to be less than a period Tx-Qg between the heater OFF time point Tx to a time point Qg at which the temperature falls below the phase-change temperature Trf1 when the defrost heater 330 is only continuously turned on in the defrost operation mode Pdf. Accordingly, it may be possible to improve the defrosting efficiency and power consumption when the continuous operation mode Pona and the pulse operation mode Ponb are performed.

Meanwhile, the controller 310 may be configured to control a size of an overheat temperature region Arba equal to higher than the defrosting end temperature Trf2 when the continuous operation mode Pona and the pulse operation mode Ponb are performed in the defrost operation mode Pdf to be less than an overheat temperature region Araa equal to higher than the defrosting end temperature Trf2 when the defrost heater 330 is only continuously turned on in the defrost operation mode Pdf. Accordingly, it may be possible to improve the defrosting efficiency and power consumption when the continuous operation mode Pona and the pulse operation mode Ponb are performed.

In FIG. 10, (d) shows a cooling power supply waveform COa in the case of only continuously turning on the defrost heater 330 and a cooling power supply waveform COb in the case of performing a continuous operation mode Pona and a pulse operation mode Ponb.

Referring to the drawing, the controller 310 may be configured to control a cooling power supply time point Tcb according to a normal cooling operation mode Pga when the continuous operation mode Pona and the pulse operation mode Ponb are performed in the defrost operation mode Pdf to be later than a cooling power supply time point Tca according to the normal cooling operation mode Pga when the defrost heater 330 is only continuously turned on in the defrost operation mode Pdf.

Accordingly, it is possible to improve the defrosting efficiency and power consumption when the continuous operation mode Pona and the pulse operation mode Ponb are performed.

Figure 11:
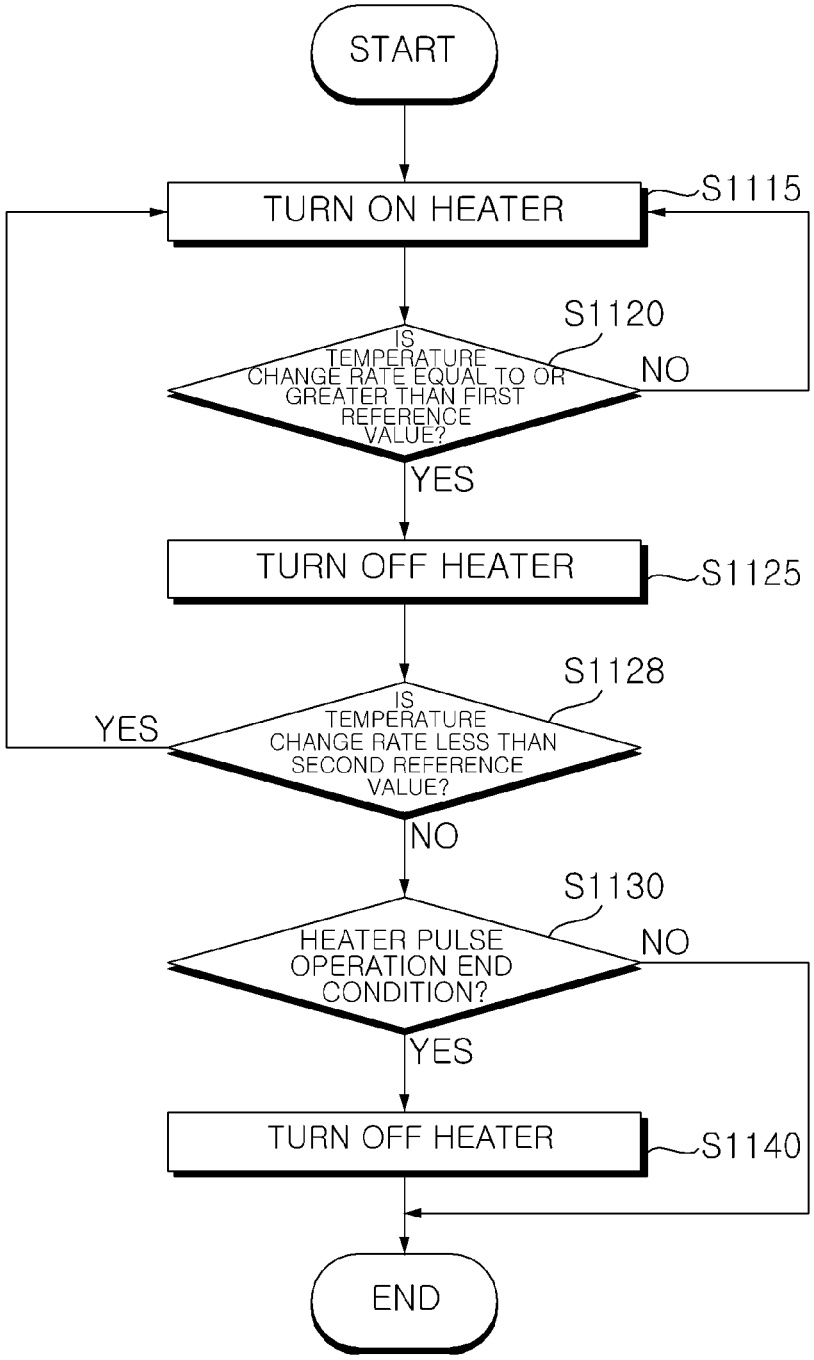

FIG. 11 is a flowchart illustrating an operating method in a pulse operation mode according to an embodiment of the present disclosure.

Referring to the drawing, the controller 310 controls the defrost heater 330 to be turned on based on the heater operation mode, in particular, based on the continuous operation mode (S1115).

Next, the controller 310 calculates a change rate ΔT of a temperature detected by the temperature sensor 320 during the operation of the defrost heater 330, and determines whether the change rate ΔT of the temperature is equal to or greater than a first reference value ref1 (S1120).

For example, when the change rate ΔT of the temperature during the continuous operation of the defrost heater 330 is less than the first reference value ref1, the controller 310 may control the defrost heater 330 to continuously operate.

Meanwhile, when the change rate ΔT of the temperature during the continuous operation of the defrost heater 330 is equal to or greater than the first reference value ref1, the controller 310 may temporarily turn off the defrost heater 330 (S1125).

Next, the controller 310 calculates the change rate ΔT of the temperature detected by the temperature sensor 320 after the defrost heater 330 is temporarily turned off, and determine whether the change rate ΔT of the temperature is less than or equal to a second reference value ref2 (S1128).

When the change rate ΔT of the temperature detected by the temperature sensor 320 is less than or equal to the second reference value ref2 after the defrost heater 330 is temporarily turned off, the controller 310 is configured to turn on the defrost heater. That is, the controller 310 controls to perform step S1115.

As such, when steps 1115 to 1128 are repeated, the pulse operation mode of the defrost heater 330 is performed.

Meanwhile, in step S1128, after the defrost heater 330 is temporarily turned off, when the change rate ΔT of the temperature exceeds the second reference value ref2, the controller 310 determines a pulse operation mode end condition is met. When the pulse operation mode end condition is met (S1130), the controller 310 ends the pulse operation mode and controls the heater to be turned off (S1140).

The pulse operation mode end condition may correspond to the pulse operation mode end time point.

For example, the pulse operation mode end time point may be a time at which the temperature detected by the temperature sensor 320 falls below the phase-change temperature Trf1.

As another example, the pulse operation mode end time point may be an end time point of the defrosting operation or an end time point of the heater operation mode.

Meanwhile, when the defrosting operation start time point To arrives, the controller 310 controls to perform the defrost operation mode Pdf and controls to perform the continuous operation mode Pona in which the defrost heater 330 is continuously turned on and the pulse operation mode Ponb in which the defrost heater 330 is repeatedly turned on and off based on the defrost operation mode Pdf, and in response to performing the pulse operation mode Ponb, the controller controls the defrost heater 330 to be turned on and off based on the change rate ΔT of the temperature detected by the temperature sensor 320. Accordingly, since defrosting may be performed based on the change rate ΔT of the temperature, it may be possible to improve defrost efficiency and power consumption.

In particular, since defrosting is performed according to the actual amount of frost ICE on the evaporator 122, it may be possible to improve defrost efficiency and power consumption.

Meanwhile, the controller 310 may control to perform the continuous operation mode Pona or the pulse operation mode Ponb based on the change rate ΔT of the temperature detected by the temperature sensor 320. Accordingly, it may be possible to improve the defrosting efficiency and power consumption.

Meanwhile, the controller 310 may be configured to operate the heater with power inversely proportional to the change rate ΔT of the temperature detected by the sensor during the pulse operation mode Ponb. Accordingly, it may be possible to improve the defrosting efficiency and power consumption.

Meanwhile, the controller 310 may be configured to decrease a period of performing the defrost operation mode Pdf as the number of opening times of the cooling compartment door increases. Accordingly, it may be possible to improve the defrosting efficiency and power consumption.

Figure 12A:
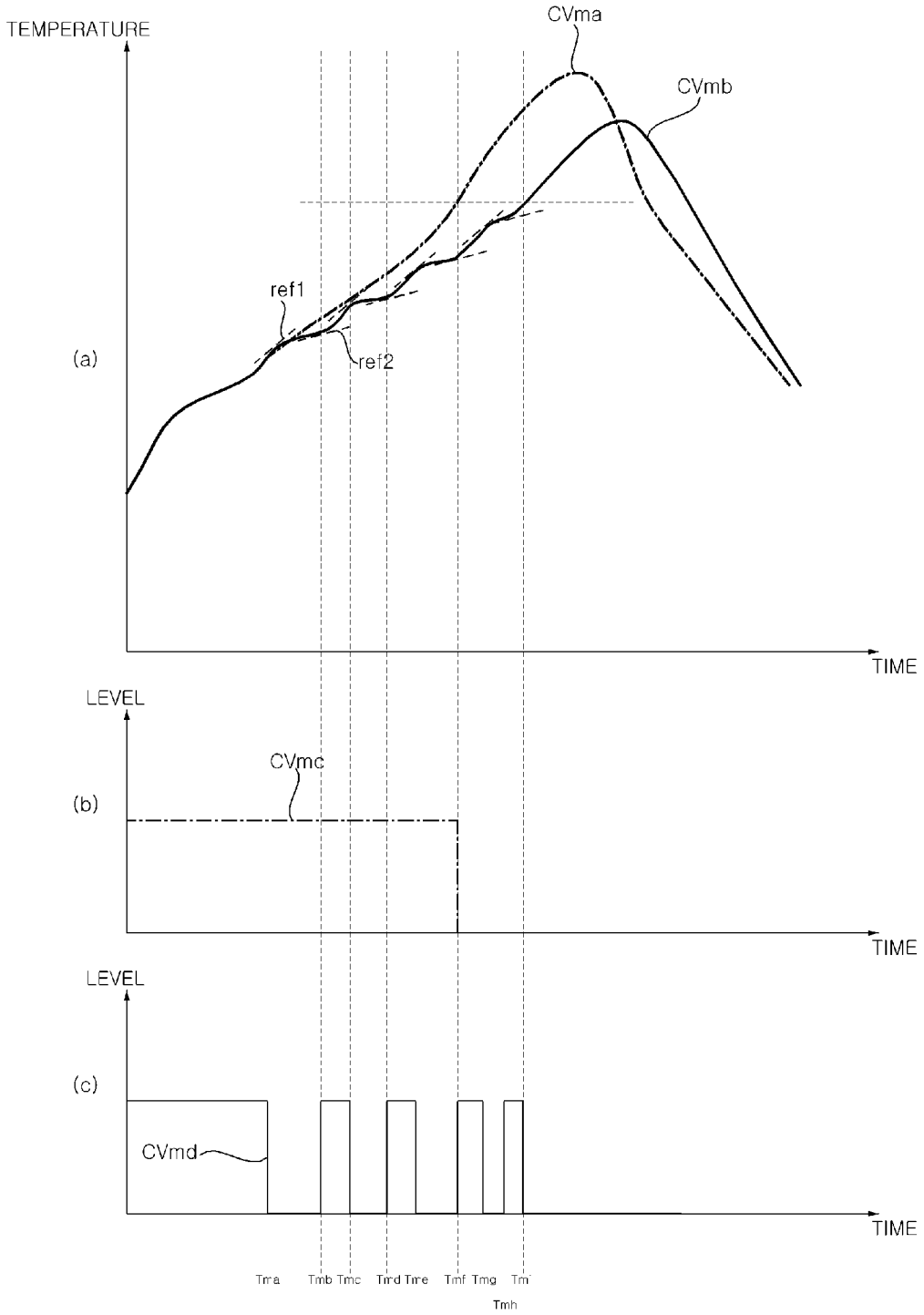

FIG. 12A is a diagram showing a temperature waveform of the evaporator when there is a large amount of frost formation.

In FIG. 12A, (a), CVma represents a temperature change waveform in response to the defrost heater being operated only in the continuous operation mode, and CVmb represents a temperature change waveform in response to the defrost heater being operated by mixing the continuous operation mode and the pulse operation mode.

According to CVma, the defrost heater 330 may be continuously turned on, and may be turned off at a time point Tmg, as shown in (b) of FIG. 12A.

According to CVmb, as shown in (c) of FIG. 12A, the defrost heater 330 is continuously turned on during a period ending in Tma and turned off during Tma and Tmb, during Tmc and Tmd, during Tme and Tmf, and during Tmg and Tmh, and the defrost heater 330 is turned on during Tmb and Tmc, during Tmd and Tme, during Tmf and Tmg, and during Tmh and Tmi.

That is, from Tma to Tmi, the defrost heater 330 operates in the pulse operation mode.

Meanwhile, the controller 310 controls the defrost heater 330 to be continuously turned on based on the continuous operation mode Pona, and in the ON state of the defrost heater 330, when the change rate ΔT of the ambient temperature of the evaporator 122 detected by the temperature sensor 320 is equal to or greater than the first reference value ref1, the controller 310 may enter the pulse operation mode Ponb and control the defroster heater 330 to be turned off. Accordingly, it may be possible to improve the defrosting efficiency and power consumption.

Meanwhile, when the defrost heater 330 is turned off during the pulse operation mode Ponb and the change rate ΔT of the temperature around the evaporator 122 is equal to or less than the second reference value ref2 that is less than the first reference value ref1, the controller 310 may control the defrost heater 330 to be turned on. Accordingly, it may be possible to improve the defrosting efficiency and power consumption.

Meanwhile, when the defrost heater 330 is turned on during the pulse operation mode Ponb and the change rate ΔT of the temperature around the evaporator 122 is equal to or greater than the first reference value ref1, the controller 310 may control the defrost heater 330 may to be turned on. Accordingly, it may be possible to improve the defrosting efficiency and power consumption.

Meanwhile, the controller 310 may control the defrost heater 330 to be continuously turned on based on the continuous operation mode Pona, and based on the pulse operation mode Ponb, the controller 310 may repeatedly turned on and off the defrost heater 320 so that the change rate ΔT of the temperature around the evaporator 122 may be between the first reference value ref1 and the second reference value ref2. Accordingly, it may be possible to improve the defrosting efficiency and power consumption.

Figure 12B:
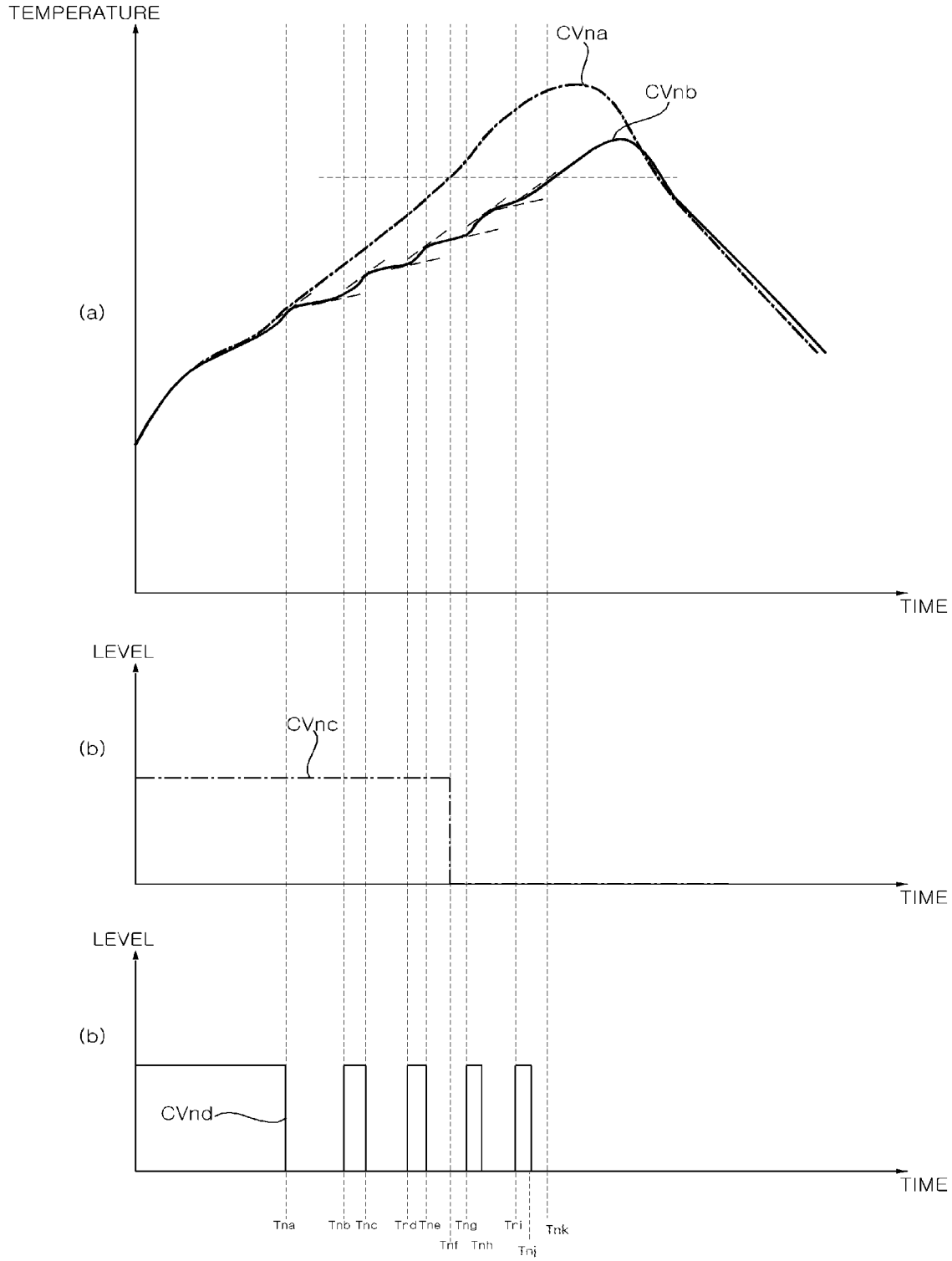

FIG. 12B is a diagram showing a temperature waveform of the evaporator when the amount of frost formation is less than that of FIG. 12A.

In (a) of FIG. 12B, CVna represents a temperature change waveform in response to the defrost heater being operated only in the continuous operation mode, and CVnb represents a temperature change waveform in response to the defrost heater being operated by mixing the continuous operation mode and the pulse operation mode.

According to CVna, the defrost heater 330 may be continuously turned on and may be turned off at a time point Tnf, as shown in (b) of FIG. 12B.

According to CVnb, as shown in (c) of FIG. 12*b*, the defrost heater 330 is continuously turned on during a period offending in Tna, and the defrost heater 330 is turned off during Tna and Tnb, during Tnc and Tnd, during Tne and Tng, and during Tnh and Tni, and turned on during Tnb and Tnc, during Tnd and Tne, during Tng and Tnh, and during Tni and Tnj.

That is, from Tna to Tnj, the defrost heater 330 operates in the pulse operation mode.

Figure 13:
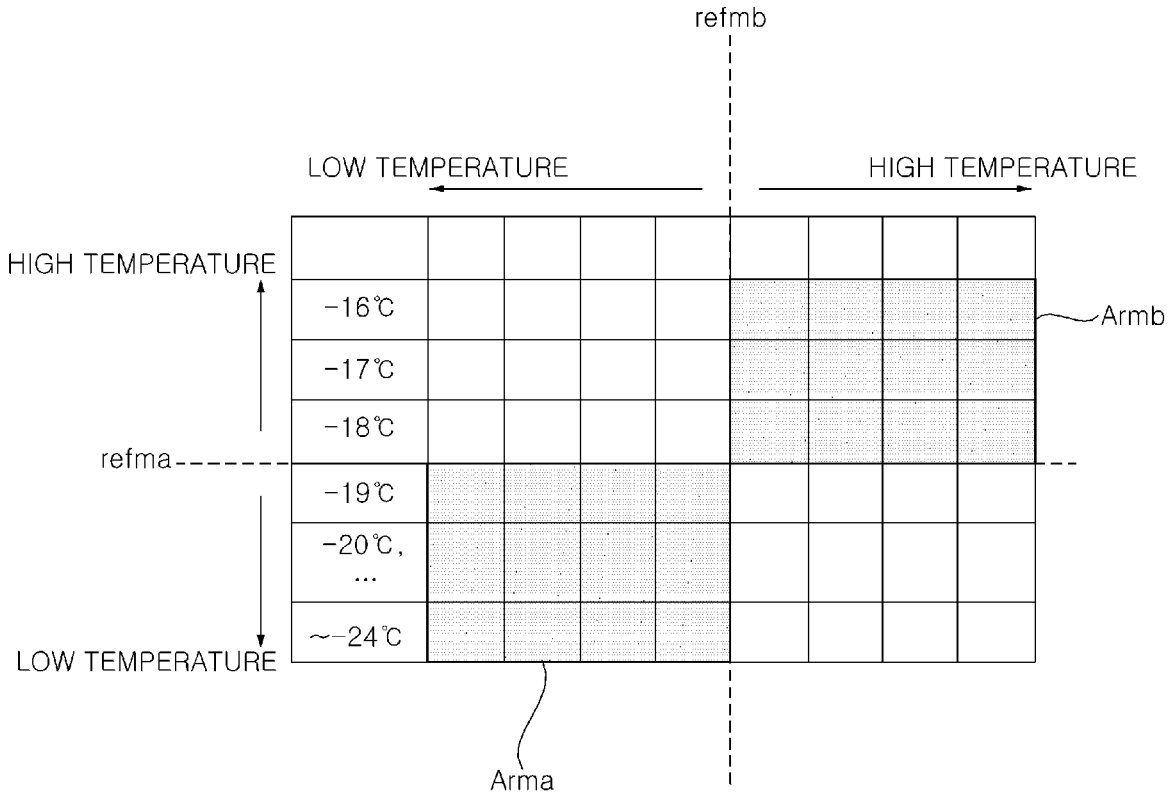

FIG. 13 is a view showing a region requiring cooling power supply and a region requiring defrosting according to temperatures of the refrigerating compartment and the freezer compartment.

Referring to the drawing, the horizontal axis may indicate a temperature of the refrigerating compartment, and the vertical axis may indicate a temperature of the freezer compartment.

When a temperature is equal to or lower than a reference temperature of the freezer compartment refma, it may indicate that a freezing capacity is sufficient, and when the temperature is equal to or lower than a reference temperature of the refrigerating compartment refmb, it may indicate that cooling capacity of the refrigerating compartment is sufficient.

An Arma region in the drawing is a region in which freezing capacity of the freezer compartment and cooling capacity of the refrigerating compartment are sufficient, and may be a region requiring defrosting.

Accordingly, when the defrosting required region is satisfied based on the temperature of the refrigerating compartment and the freezer compartment, the controller 310 may control to perform the continuous operation mode and the pulse operation mode described above. In particular, ON/OFF of the defrost heater 330 in the pulse operation mode may be controlled based on a temperature change rate around the evaporator 122.

Meanwhile, the Armb region in the drawing may be a region in which both cooling power of the freezer compartment and cooling power of the refrigerating compartment are insufficient, and may be a cooling power supply requiring region requiring cooling power supply.

Accordingly, the controller 310 may control supply of cooling power. For example, a compressor may be operated or a thermoelectric element may be operated to control the supply of cooling power.

Figure 14:
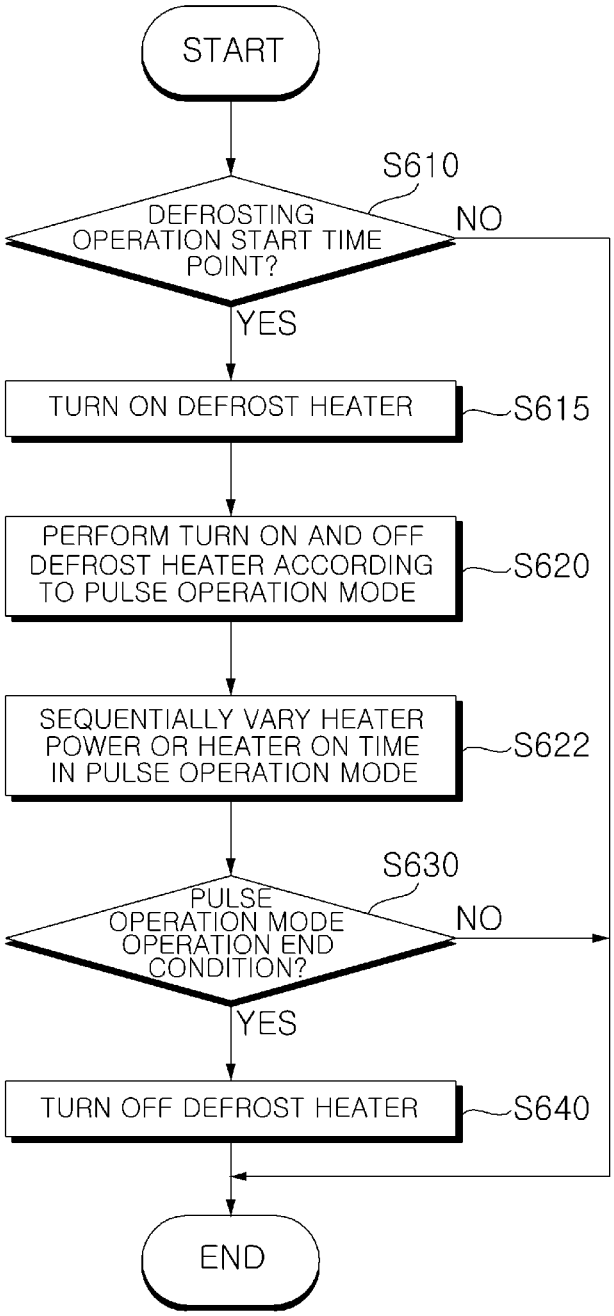
FIG. 14 is a flowchart illustrating a method of operating a refrigerator according to another embodiment of the present disclosure.

FIG. 14 is a flowchart illustrating a method of operating a refrigerator according to another embodiment of the present disclosure, and FIGS. 15A to 15D are diagrams referenced in the description of FIG. 14.

Referring to FIG. 14, the controller 310 of the refrigerator 100 according to the embodiment of the present disclosure may determine whether it is a defrosting operation start time point for defrosting (S610).

For example, the controller 310 of the refrigerator 100 may determine whether it is a defrosting operation start time point while performing a normal cooling operation mode Pga. The defrosting operation start time point may be changed according to the defrosting period.

Meanwhile, when the defrosting operation start condition is satisfied, for example, in response to the defrosting operation start time point arriving, the controller 310 of the refrigerator 100 ends the normal cooling operation mode, and may control a defrost operation mode Pdf to be performed, and control the defrost heater 330 to be continuously turned on based on a heater operation mode PddT in a defrost operation mode Pdf (S615).

Next, the controller 310 of the refrigerator 100 may control a pulse operation mode, in which the defrost heater 330 is repeatedly turned on and off, to be performed by a heater pulse after the defrost heater 330 is continuously turned on (S620).

For example, when the defrosting operation start condition is satisfied, the controller 310 of the refrigerator 100 may control the defrost operation mode Pdf, which includes the pre-defrost cooling mode Pbd, the heater operation mode PddT, and the post-defrost cooling mode pbf, to be performed.

Based on the heater operation mode PddT and the defrost operation mode Pdf, the controller 310 may control the continuous operation mode Pona, in which the defrost heater 330 is continuously turned on, and the pulse operation mode Ponb, in which the defrost heater 330 is repeatedly turned on and off, to be performed.

Meanwhile, the controller 310 may control the defrost heater 330 to be continuously turned on based on the continuous operation mode Pona, and perform the pulse operation mode Ponb based on the change rate of the ambient temperature of the evaporator detected by the temperature sensor 320 in the ON state of the defrost heater 330. Accordingly, it may be possible to improve the defrosting efficiency and reduce the power consumption.

Meanwhile, when the temperature detected by the temperature sensor 320 corresponds to a predetermined temperature, the controller 310 may control the pulse operation mode Ponb to be performed.

Meanwhile, when the temperature detected by the temperature sensor 320 corresponds to a predetermined temperature, and the duration of the continuous operation mode is greater than or equal to a predetermined period Pona, the controller 310 may control the pulse operation mode Pona to be performed.

Meanwhile, in response to the duration of the continuous operation mode being greater than or equal to a predetermined period, the controller 310 may control the pulse operation mode Ponb to be performed.

Meanwhile, when a temperature change rate QT of the temperature detected by the temperature sensor 320 corresponds to a predetermined temperature, the controller 310 may control the pulse operation mode Ponb to be performed.

Meanwhile, the controller 310 of the refrigerator 100 may control power of the heater or an ON time of the heater to sequentially vary in response to performing the pulse operation mode Ponb (S622).

For example, in response to performing the pulse operation mode Ponb, the controller 310 may control the ON period or the power level of the defrost heater 330 to be decreased stepwise or sequentially. Accordingly, the present disclosure may improve defrosting efficiency and power consumption. In particular, since the defrosting is performed according to the amount of frost on the actual evaporator, it may be possible to improve defrosting efficiency and power consumption.

Next, the controller 310 of the refrigerator 100 determines whether it is the pulse operation mode end time point (S630), and if so, turns off the defrost heater 330 (S640).

For example, the pulse operation mode end point time may be a time point at which the temperature detected by the temperature sensor 320 falls below the phase-change temperature Trf1.

As another example, the pulse operation mode end time point may be a defrost operation end time point or a heater operation mode end time point.

Figure 15A:
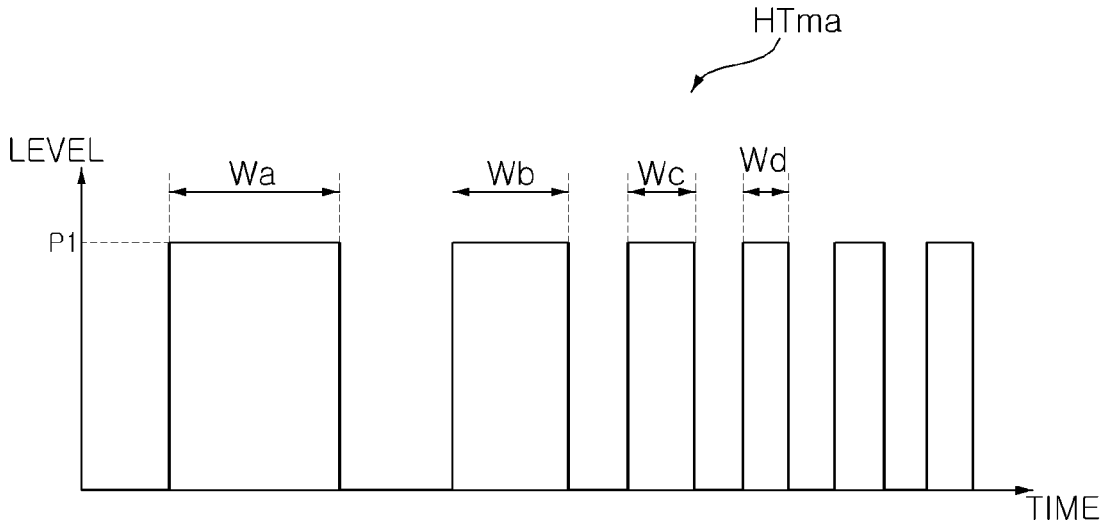
FIGS. 15A to 15D are diagrams referenced in the description of FIG. 14.

FIG. 15A illustrates that an ON time of the defrost heater 330 is sequentially decreased or stepwise decreased in response to performing the pulse operation mode.

Referring to the drawing, in response to performing the pulse operation mode Ponb, the controller 310 may control the defrost heater 330 to be turned on during a first turn on period Wa, the defrost heater 330 to be turned off during a first turn off period, and the defrost heater 330 to be turned on during a second turn on period Wb that is less than the first turn on period Wa. Accordingly, it may be possible to perform the defrosting while the power consumption sequentially consumed by the defrost heater 330 is reduced.

Meanwhile, as illustrated in FIG. 15A, in response to performing the pulse operation mode Ponb, the controller 310 may control the defrost heater 330 to be turned on during a fourth turn on period Wd, which is a minimum ON period, after the third turn on period Wc.

In the drawing, the fourth turn on period Wd are exemplified three times, but various modifications are possible.

Meanwhile, the controller 310 may control the power level of the defrost heater 330 to be constant while the ON time of the defrost heater 330 is variable.

FIG. 15A illustrates that the defrost heater 330 operates at a P1 level, which is the same power level, during the first turn on period Wa, the second turn on period Wb, the third turn on period Wc, and the fourth turn on period Wd.

Meanwhile, the controller 310 may be configured to turn on the defrost heater at the first power level P1 during the first turn on period Wa and the defrost heater 330 to be turned on at the first power level P1 during the third turn on period Wc.

Figure 15B:
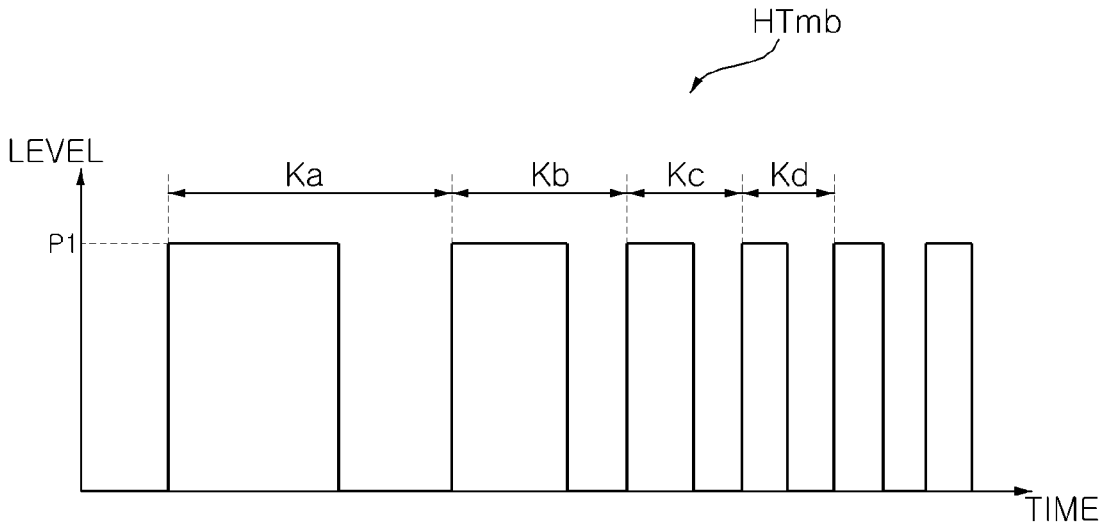

FIG. 15B illustrates that an operation period of the defrost heater 330 is sequentially decreased or stepwise decreased in response to performing the pulse operation mode. In particular, the ON time of the defrost heater 330 sequentially decreases as the operation period decreases.

Referring to the drawing, in response to performing the pulse operation mode Ponb, the controller 310 may control the defrost heater 330 to be turned on and off during a first operation period Ka, and the defrost heater 330 to be turned on and off during a second operation period Kb less than the first operation period Ka. Accordingly, the ON time of the defrost heater 330 is sequentially decreased.

Meanwhile, in response to performing the pulse operation mode Ponb, the controller 310 may control the defrost heater 330 to be turned on and off during a third operation period Kc less than the second operation period Kb after the second operation period Kb, and the defrost heater 330 to be turned on and off during a fourth operation period Kd, which is a minimum period, after the third operation period Kc.

Accordingly, it may be possible to perform the defrosting while the power consumption sequentially consumed by the defrost heater 330 is reduced.

Figure 15C:
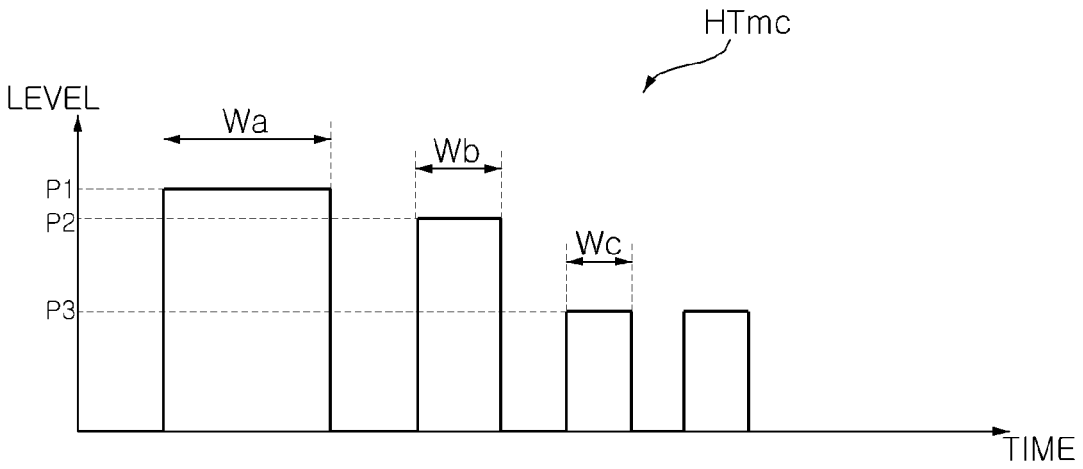

FIG. 15C illustrates that the power level of the defrost heater 330 is sequentially decreased or stepwise decreased in response to performing the pulse operation mode.

Referring to the drawing, in response to performing the pulse operation mode Ponb, the controller 310 may control the defrost heater 330 to be turned on based on the first power level P1 during the first turn on period Wa, the defrost heater 330 to be turned off during the first turn off period, and the defrost heater 330 to be turned on at the second power level P2 that is less than the first power level P1 during the second turn on period Wb.

Meanwhile, in response to performing the pulse operation mode Ponb, the controller may control the defrost heater 330 to be turned on at the third power level P3, which is the minimum power level, after the second turn on period Wb.

Referring to FIG. 15C, the defrost heater 330 may be turned on at the first power level P1 during the first turn on period Wa, turned on at the second power level P2 that is less than the first power level P1 during the second turn on period Wb that is less than the first turn on period Wa, and turned on at the third power level P3 that is less than the second power level P2 during the third turn on period Wc that is less than the second turn on period Wb.

Accordingly, it may be possible to reduce the power level and reduce the ON time, and as a result, perform the defrosting while sequentially reducing the power consumption consumed by the defrost heater 330.

Figure 15D:
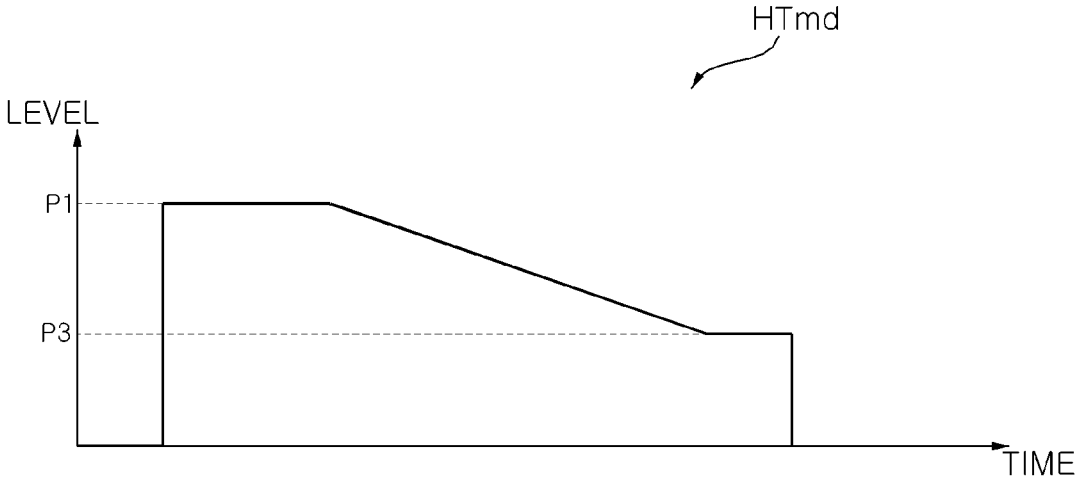

FIG. 15D illustrates that the power level of the defrost heater 330 is sequentially and continuously decreased.

Referring to the drawing, the defrost heater 330 may be turned on and the power may maintain the first power level P1 for a predetermined time, and then be sequentially decreased to the third power level P3, and then maintain the third power level P3 for a predetermined time. Accordingly, it may be possible to perform the defrosting while the power consumption sequentially consumed by the defrost heater 330 is reduced.

In the refrigerator according to the present disclosure, the configuration and the method of the embodiments as described above are not restrictively applied. Rather, all or some of the embodiments may be selectively combined with each other so that the embodiments may be variously modified.

In addition, although the preferred embodiments of the present disclosure have been illustrated, the present disclosure is not limited to the specific embodiments described above, and can be variously modified by those skilled in the art to which the present disclosure pertains without departing from the gist of the present disclosure claimed in the claims, and these modifications should not be understood individually from the technical ideas or prospects of the present disclosure.

The present disclosure may be applied to a refrigerator, and more particularly, may be applied to a refrigerator capable of improving defrosting efficiency and power consumption.

What is claimed is:

1. A refrigerator, comprising:

an evaporator configured to perform heat exchange;

a defrost heater configured to operate to remove frost formed on the evaporator;

a temperature sensor configured to detect an ambient temperature of the evaporator;

a controller configured to control the defrost heater;

a refrigerating compartment fan; and a freezer compartment fan, wherein, in response to a defrosting operation start time point arriving, the controller is configured to perform a defrost operation mode including a pre-defrost cooling mode, a heater operation mode, and post-defrost cooling mode, perform a continuous operation mode, in which the defrost heater is continuously turned on, and a pulse operation mode, in which the defrost heater is repeatedly turned on and off based on the defrost operation mode, wherein the heater operation mode includes:

a first time period in which the continuous operation mode is performed, a second time period in which the pulse operation mode is performed, a third time period in which the defrost heater is turned off after the second time period, wherein during the third time period, the freezer compartment fan is turned off, wherein the pre-defrost cooling mode before the heater operation mode includes:

a fourth time period in which the refrigerating compartment fan is turned on and the freezer compartment fan is turned off, and a fifth time period after the fourth time period in which the refrigerating compartment fan is turned off and the freezer compartment fan is turned on.

2. The refrigerator of claim 1, wherein, in response to performing the pulse operation mode, the controller is configured to decrease an ON period or a power level of the defrost heater stepwise or sequentially.

3. The refrigerator of claim 1, wherein, in response to performing the pulse operation mode, the controller is configured to turn on the defrost heater on during a first period, turn off the defrost heater during a second period, and turn on the defrost heater during a third period less than the first period.

4. The refrigerator of claim 3, wherein, in response to performing the pulse operation mode, the controller is configured to turn on the defrost heater during a fourth period corresponding to a minimum ON period after turning off the defrost heater after the third period.

5. The refrigerator of claim 3, wherein the controller is configured to turn on the defrost heater at a first power level during the first period and turn on the defrost heater at the first power level during the third period.

6. The refrigerator of claim 1, wherein, in response to performing the pulse operation mode, the controller is configured to turn on and off the defrost heater during a first period, and turn on and off the defrost heater during a second period less than the first period.

7. The refrigerator of claim 6, wherein, in response to performing the pulse operation mode, the controller is configured to turn on and off the defrost heater during a third period less than the second period, and turn on and off the defrost heater during a fourth period, which is a minimum period, after the third period.

8. The refrigerator of claim 1, wherein, in response to performing the pulse operation mode, the controller is configured to turn on the defrost heater based on a first power level during a first period, turn off the defrost heater during a second period, and turn on the defrost heater at a second power level less than the first power level during a third period.

9. The refrigerator of claim 8, wherein, in response to performing the pulse operation mode, the controller is configured to turn on the defrost heater at a third power level, which is a minimum power level, after the third period.

10. The refrigerator of claim 1, wherein, in response to the defrosting operation start time point arriving while performing a normal cooling operation mode, the controller is configured to perform the defrost operation mode including a pre-defrost cooling mode, a heater operation mode, and a post-defrost cooling mode, and perform the continuous operation mode of the defrost heater and the pulse operation mode in which the defrost heater is repeatedly turned on and off based on the heater operation mode.

11. The refrigerator of claim 1, wherein the controller is configured to continuously turn on the defrost heater based on the continuous operation mode, in an ON state of the defrost heater, in response to a change rate of the ambient temperature of the evaporator detected by the temperature sensor being greater than or equal to a first reference value, enter the pulse operation mode, and turn off the defrost heater, and in a state in which the defrost heater is turned off during the pulse operation mode, in response to the change rate of the ambient temperature of the evaporator being less than or equal to a second reference value less than the first reference value, turn on the defrost heater.

12. The refrigerator of claim 11, wherein the controller is configured to turn off the defrost heater based on an end condition of the pulse operation mode.

13. The refrigerator of claim 1, wherein the controller is configured to continuously turn on the defrost heater based on the continuous operation mode, and repeatedly turn on and off the defrost heater for the change rate of the ambient temperature of the evaporator to be between the first reference value and the second reference value based on the pulse operation mode.

14. The refrigerator of claim 1, wherein, in response to the temperature detected by the temperature sensor being a predetermined temperature, in response to the temperature detected by the temperature sensor being a predetermined temperature and a duration of a continuous operation mode being greater than a predetermined period, or in response to the duration of the continuous operation mode being the predetermined period, the controller is configured to perform the pulse operation mode.

15. The refrigerator of claim 1, wherein the controller is configured to perform the pulse operation mode based on a temperature change rate of a temperature detected by the temperature sensor.

16. The refrigerator of claim 1, wherein the controller is configured to operate the heater with power inversely proportional to a temperature change rate of the temperature detected by the sensor during the pulse operation mode.

17. The refrigerator of claim 1, wherein as the number of opening times of the cooling compartment door increase, the controller is configured to decrease a duration of the defrost operation mode.

18. The refrigerator of claim 1, wherein, in response to performing the pulse operation mode, the controller is configured to turn on and off the defrost heater based on the change rate of the temperature detected by the temperature sensor.

19. The refrigerator of claim 1, wherein, in response to performing the pulse operation mode, the controller is configured to turn on and off the defrost heater based on a change rate of the temperature detected by the temperature sensor.

20. The refrigerator of claim 1, wherein, the controller is configured to control a size of a second section related to temperature versus time between a phase-change temperature and the defrost end temperature in response to the continuous operation mode and the pulse operation mode being performed in the defrost operation mode to be greater than a size of a first section related to temperature versus time between the phase-change temperature and the defrost end temperature in response to the defrost heater being only continuously turned on in the defrost operation mode.

21. The refrigerator of claim 1, wherein during the first time period and the second time period of the heater operation mode, the freezing compartment fan is turn on.

22. The refrigerator of claim 1, wherein the post-defrost cooling mode after the heater operation mode includes:

a sixth time period in which the refrigerating fan is turned on, and a seventh time period after the sixth time period in which the refrigerating fan is turned off and the freezer compartment fan remains turned on.

* * * * *